US006055921A

United States Patent [19]

Olewicz et al.

[11] Patent Number: 6,055,921

[45] Date of Patent: May 2, 2000

[54] WAISTBAND ATTACHMENT SYSTEM

[75] Inventors: Tadeusz Olewicz, Hoschton; Michael R. Pate, Sugar Hill, both of Ga.

[73] Assignee: Atlanta Attachment Company, Lawrenceville, Ga.

[21] Appl. No.: 09/062,471

[22] Filed: Apr. 17, 1998

Related U.S. Application Data

[63] Continuation-in-part of application No. 09/026,051, Feb. 19, 1998.

[51] Int. Cl.[7] ..... D05B 33/00

[52] U.S. Cl. ..... 112/475.07; 112/470.33; 112/470.36

[58] Field of Search ..... 112/470.36, 470.05, 112/470.06, 470.14, 470.18, 470.33, 475.04, 475.05, 475.07, 470.07, 306

[56] References Cited

U.S. PATENT DOCUMENTS

| | | | |
|---|---|---|---|
| 3,701,328 | 10/1972 | Frost | 112/470.36 |
| 3,789,781 | 2/1974 | Carson et al. | 112/470.36 |
| 3,970,014 | 7/1976 | Chano et al. | 112/121.11 |
| 4,046,087 | 9/1977 | Manetti | 112/121.15 |
| 4,053,967 | 10/1977 | Mair | 26/98 |
| 4,098,201 | 7/1978 | Adamski, Jr. et al. | 112/2 |
| 4,265,187 | 5/1981 | Torre | 112/121.26 |
| 4,473,017 | 9/1984 | Letard et al. | 112/141 |
| 4,484,532 | 11/1984 | Norz | 112/2 |
| 4,681,051 | 7/1987 | Kirch et al. | 112/306 |
| 4,928,610 | 5/1990 | Akutsu | 112/153 |
| 5,188,047 | 2/1993 | Rohr et al. | 112/262.2 |
| 5,251,557 | 10/1993 | Rohr | 112/306 |
| 5,269,239 | 12/1993 | Adamski, Jr. et al. | 112/121.27 |
| 5,269,257 | 12/1993 | Yamazaki | 112/262.2 |
| 5,437,238 | 8/1995 | Price et al. | 112/470.29 |
| 5,456,192 | 10/1995 | Trigg et al. | 112/470.05 |
| 5,522,332 | 6/1996 | Price et al. | 112/470.29 |
| 5,562,060 | 10/1996 | Price et al. | 112/470.29 |
| 5,570,647 | 11/1996 | Adamski, Jr. et al. | 112/470.31 |
| 5,657,711 | 8/1997 | Price et al. | 112/470.33 |

FOREIGN PATENT DOCUMENTS 2219319A 6/1989 United Kingdom .

*Primary Examiner*—Peter Nerbun

*Attorney, Agent, or Firm*—Womble Carlyle Sandridge & Rice, PLLC

[57] ABSTRACT

A waistband attachment system (10) for sewing an elastic waistband into the waist portion of a garment is disclosed. The waistband attachment system includes a sewing head assembly (16), a puller roller assembly (24), a waistband expansion assembly (44), a bottom edge guide assembly (64), a folder wire (102), a top edge guide assembly (128), and a folder assembly (148) about which the elastic waistband and the unfolded waist edge of the garment are passed, and a stacking assembly (400). The unfinished waist edge of the garment is folded about the elastic waistband by the folder wire and finish folded by the combination of folder tongue/finish folder so that a top ply of the waist portion of the garment overlies an opposed bottom ply to enclose the elastic waistband therein. The bottom edge and top edge guide assemblies, respectively, are constructed and arranged to progressively move the waist edge of the garment into a knife (170) of the sewing head assembly for trimming the excess portion of the waist edge along the folded and hemmed waistband as it is sewn into the garment. Thereafter, the stacking assembly removes each garment for stacking as part of a garment bundle.

14 Claims, 22 Drawing Sheets

WAISTBAND ATTACHMENT SYSTEM

CROSS REFERENCE TO RELATED APPLICATION

This application is a continuation-in-part application of U.S. patent application Ser. No. 09/026,051, filed Feb. 19, 1998.

FIELD OF THE INVENTION

This invention relates in general to a waistband attachment system for use in sewing elastic waistbands to the waist portions of tubular garments, for example skirts, pants, etc. More particularly, the invention relates to a waistband attachment system having an automated expansion assembly, an improved bottom edge guide assembly, a unique folder wire assembly, and improved top edge guide and folder assemblies and stacking assembly for folding a top ply of the garment about the elastic waistband onto a bottom ply of the garment and aligning a continuous hem sewn into the garment to attach the elastic waistband thereto, and automatically removing and stacking the finished garments in bundles for further processing.

BACKGROUND OF THE INVENTION

In the production of garments in commercial or industrial settings, batches of work pieces, for example tubular shirts or pants, are processed through separate work stations for being formed into finished work pieces. The separate finished work pieces may then be conveyed to another work station, if needed, for combining all of the work pieces into a finished item of clothing. For example, it is common for a work piece to have its sides seamed to form a tubular garment body, after which the work piece is then taken to a separate waistband attachment machine for attaching an elastic waistband to the waistband portion of the garment.

The production of garments is typically accomplished in a high volume, high speed operation in which consistently sized and high quality finished garments are desired at the end of the fabrication process. One problem in working with textile or cloth work pieces, however, is that they tend to have a natural elasticity which is typically exhibited during handling such that wrinkles, or undesired curls or folds may occur in the work piece as it is being processed. A common problem in the formation of elastic waistbands is that curls tend to form along the waistband and may be sewn therein, resulting in a defective garment. Another problem is the formation of tabs near the stitched thread chain forming the hem of the garments: For example the stitches attaching the waistband to the garment, gathers excess cloth not otherwise controlled during the sewing operation, forming a tab of excess cloth at the finished seam on the completion of sewing the hem. Again, this results in a poorly finished garment, requiring the garment to be re-sewn, or treated as a second or a reject.

In the formation of elastic waistbanded garments such as sweat shirts or sweat pants, a garment with the fabric folded tightly around the elastic waistband is recognized as being of superior quality. Currently, there are two primary conventional methods of attaching elastic waistbands to the waistband portions of garments which involves either a "simple" two-step process, or a one-step process which requires the use of highly skilled and trained workers. In the two-step process, the elastic waistband is first surged to the unfinished waist edge of the waistband portion of a garment. Thereafter, an operator will manually flip the elastic waistband and the waist edge of the garment to which the waistband is sewn over such that the waistband is covered by top and bottom plies, whereupon a hem is sewn in the garment and waistband to attach the waistband to the garment. This process also can be accomplished in a single step, provided the machine operator first aligns the elastic waistband with the unfinished waist edge of the garment, and then manually folds the waistband into the garment, and maintains this folded and aligned relationship of the waistband and the waist edge to form a finished hem while the machine operates. However, this single step process requires significant amounts of time and effort be spent in training workers to perform this operation with sufficient precision and accuracy to enable sufficient production and quality.

The primary problem that still persists with either of these known methods of sewing waistbands, however, is that curls and/or tab formation can still result during production of the garment, requiring either a re-sew or repair of the garment, or the rejection of the garment as a second. Another significant problem encountered when performing conventional methods is the formation of pleats in the garment created at the end of the sewing operation. Such pleats are generated by the edge guiding systems used for controlling the placement of the edges of the garment and waistband, which typically include grippers or star wheels that are rotated perpendicular to the sewing path. These grippers or star wheels create friction on the garment as the fabric is moved through the edge guide, this friction pulls on the fabric as the fabric is advanced along its sewing path. This friction or pulling on the fabric causes the fabric to stretch and thus move at a slower rate than the elastic of the waistband, creating an accumulation of excess fabric at the end of the sewing cycle which results in a pleat being sewn in the garment. Such pleats detract from the appearance of the garment and can cause the garment to be rejected and either discarded or sold as a defective or "second" garment.

U.S. Pat. No. 5,437,238 (the "'238 patent") to Price, et al., discloses a waistband attachment system which attempts to minimize curl formation during waistband attachment operations. In the waistband attachment system of this patent, the elastic waistband is placed in edge alignment with the waistband portion of a garment body, whereupon the garment parts are stretched together about a number of spindles to prevent curl formation. The garment is then progressed along a sewing path during a pre-sew phase to eliminate any curl by passing the folded and aligned waistband portion of the garment through an edge guide which maintains the overlying relationship of the plies of the waistband portion of the garment with the elastic waistband. Although the device of the '238 patent represented a significant advance in the art, the problem still persists that tabs or pleats may be formed in the garment during the sewing of an elastic waistband into a garment, and the system of the '238 patent still required the system operator to manually align the waist edge portion of the garment with the waistband prior to start of sewing.

The system of the '238 patent was improved upon in U.S. Pat. No. 5,522,332 (the "'332 patent") to Price, et al., which provided opposed upper and lower star wheels for urging the garment toward or away from the sewing path to ensure that the edges of the garment and waist remained in alignment for attaching the waistband. The '332 patent also provided for a further stretching of the garment about the spindles of the machine as the previously sewn edge of the waistband in the garment began to return along the sewing path to the sewing machine in the effort to further remove any curl from the waistband, and to prevent the formation of a tab at the seam of the completed waistband of the garment.

U.S. Pat. No. 5,562,060 to Price, et al. (the "'060 patent") provided yet another waistband attachment system in which the edges of a looped waistband were manually matched with the waist edge of a garment, both of which were passed over a plurality of spindles and stretched until their breadths were matched, and were then advanced along the sewing path of the machine during a pre-sew operation to ensure that the edges were automatically aligned with the sewing path of the sewing head and for removing curl in the matched edges. As the sewing cycle of this system nears completion, the waistband and the garment body are further stretched to minimize the tendency of the presser foot of the sewing machine to form a tab along the seam in the waist band of the finished garment.

What none of the above-referenced patents appear to disclose, however, is a waistband attachment system designed to automatically fold a top ply of the garment about the elastic waistband and into an overlying relationship with a bottom ply of the garment, and align the unfinished waist edge of the garment with the knife of the sewing machine head to ensure that a complete and properly folded and trimmed waistband is sewn into the garment, while also minimizing the likelihood of curl or tab formation in the seam of the waistband and/or the formation of pleats in the garment. In addition, conventional waistband attachment systems typically rely on one active guide to control the edge of the fabric of the garment, with guides positioned at a distance from the target to which the edge of the fabric is to be guided. However, due to the weight of the garment, the edge of the fabric can slip from the time it is positioned by the edge guide of the system in the time that it reaches the target position. The fabric or cloth blanks also could be cut incorrectly such that the edge of the fabric does not form a straight line. As a result, the elastic of the waistband can become exposed due to this distance between the edge guide system and the target against which the edge of the fabric is to be guided, creating a poor quality garment that will be rejected as a second or defective garment.

Additionally, many conventional automated sewing stations now will include an automatic stacking device that will remove the finished garments and stack them in bundles. Typically, such stackers include a moving transport bar, a stationary clamp bar and stacker bar(s) over which the garments are stacked, and are generally positioned directly in front of the sewing station. As a result, the operator often must either lean over the stacker or try to place the garment pieces to be sewn in the sewing station from the side, causing discomfort to and hindering the ability of the worker to efficiently load and operate the sewing station. The operator further must wait for the stacker to finish removing and stacking a garment before loading the next garment, slowing down production rates.

Thus, what is needed, but seemingly unavailable in the art, is an improved waistband attachment system and method of sewing elastic waistbands to garments which minimizes operator participation required for folding a top ply of the waistband portion of a garment about an elastic waistband into an overlying relationship with a bottom ply of the garment, and aligning the unfinished waist edge of the garment with the knife and/or needles of a sewing machine prior to the start of sewing operations, and to automatically maintain this alignment during the sewing operation, which minimizes the potential for curls and tabs being formed and sewn in the garment, and which can provide further gains in productivity by allowing relatively unskilled workers to produce high quality sewn waistbands in garments at increased production rates with the potential for defects being minimized.

SUMMARY OF THE INVENTION

The present invention provides an improved waistband attachment system designed to overcome the deficiencies of waistband attachment systems and methods of sewing elastic waistbands to garments currently known in the art. The present invention automatically folds an unfinished waist edge of a garment about a continuous elastic waistband so that the waistband is enclosed between a top ply and a bottom ply of the waist portion of a garment, with the waist edge aligned with the knife of a sewing head. The attachment system of the invention then progressively feeds the waist edge into the knife as the sewing of the waistband into the garment commences to avoid curl and tab formation as a hem is sewn into the garment to attach the waistband thereto.

The waistband attachment system includes a cabinet style framework on which a work table is supported, with a sewing head assembly mounted on the work table at a sewing area. The sewing head assembly has at least one reciprocating needle and a supply of thread for sewing a continuous hem through the elastic waistband and the waistband portion of the garment, and a knife for trimming the excess portion of the unfinished waist edge of the garment as the hem is sewn. A sewing path extends through the sewing head assembly, along which the elastic waistband and the garment are advanced for forming the hem in the garment.

An improved puller assembly is mounted downstream from the sewing head assembly in the sewing path. The puller assembly includes a driven puller roller and a spring loaded compensation roller which has separate, independently moving segments for engaging the folded and sewn hem, and the body of the garment, respectively for pulling the elastic waistband, the hemmed portion of the garment, and the "body" of the garment along the sewing path and through the sewing head equally without otherwise skewing the garment. A waistband expansion assembly is mounted below the sewing head assembly and includes a pair of spindles mounted to a pivotable carrier. The waistband expansion assembly is constructed and arranged to expand the elastic waistband to a predetermined size for tensioning the waistband, whereupon the unfolded waist portion of the garment is passed about the expansion assembly so that the unfolded waistband portion of the garment overlies the waistband. The waistband expansion assembly is also adapted for automatic operation having a light beam emitter and corresponding receiver for determining when the elastic waistband has attained a predetermined expansion size to insure that it is adequately sized and tensioned, but not drawn so taut as to curl by reflecting a beam of light off of the garment during the expansion process.

A bottom edge guide assembly is positioned at the upstream end of the sewing path and guides the unfolded waist edge portion of the garment along the sewing path into a folder assembly upstream of the sewing head assembly. The folder assembly is constructed and arranged to fold the waist edge of the garment about the elastic waistband as the garment advances along the sewing path so that the top ply of the garment overlies the elastic waistband and the opposed bottom ply of the garment. A top edge guide assembly is provided downstream of the bottom edge guide assembly, constructed and arranged to selectively draw the unfinished waist edge along the bottom ply of the now folded waistband portion of the garment away from the knife of the sewing head assembly as the garment advances along the sewing path, and to form a snug, quality waistband in the garment.

The bottom edge guide assembly includes a bottom edge detector or eye that is moved inwardly toward the work table and across the sewing path when the waistband attachment operation begins sewing. This progressively overfeeds, and thus moves, the garment into the folding assembly, and progressively feeds the waist edge of the garment into the knife of the sewing head. At the same time, a trim edge detector at the folder assembly is moved outwardly of the work table and across the sewing path in the direction opposite the direction in which the bottom edge detector is moved to a predetermined position to ensure that an adequate trimmed waist edge portion is fed into the knife for trimming and to ensure that the elastic waistband is fully sewn within the hemmed waistband portion of the garment. Both the bottom edge detector and the trim edge detector include travel screws for adjusting their positions with respect to the sewing path.

The bottom edge guide assembly also includes a plurality of blowers for eliminating formation of inwardly and/or outwardly curled portions of the unfinished waist edge of the garment, as well as ripples in the body of the garment as it is advanced over a bottom edge guide idler roller toward and over a top roller. The bottom edge guide idler roller may be moved laterally with respect to the sewing path to accommodate elastic waistbands of varying widths quickly and easily, and without the need to perform any disassembly or re-assembly of the machine for use with such waistbands.

A second detector, a quality assurance eye or sensor, is provided adjacent the trim edge detector, positioned underneath a reciprocating folder tongue of the folder assembly, to stop the machine at any time it becomes uncovered by the waist edge, or top ply of the garment, which would indicate that the top ply of the garment is not fully enclosing the elastic waistband between the top ply and the opposed bottom ply, which may result in an unsatisfactorily finished work piece. In lieu of a single moveable bottom edge detector, and trim edge detector, spaced pairs of detector eyes or a single detector eye with dual output levels also may be used at the bottom edge guide and at the folder assembly to overfeed, or take away, the waistband portion of the garment into and out of engagement with the knife of the sewing head assembly, as desired.

In one preferred embodiment, the waistband attachment system can include a garment support bar selectively moveable from a first, non-engaging position on the framework of the system into a second garment engaging position for carrying at least a portion of the weight of the garment thereon as the waistband is sewn to the garment to prevent the garment from otherwise being pulled off of the waistband attachment system during the sewing. The waistband attachment system also can include a garment tumbling device having a powered conveyor belt positioned with respect to, and moving along a return portion of the sewing path in timed relationship with the movement of the waistband and the garment along the sewing path to prevent the undue twisting of the garment and to prevent the garment from being pulled off of the waistband attachment system.

A top roller is mounted adjacent the folder wire and includes a toothed indexing wheel or timing disc formed as a part thereof and which forms a series of radially spaced timing marks or indicia which pass by a proximity sensor such that if the top roller ceases to move, indicating a jammed condition in the machine, the proximity sensor signals the machine control system to automatically shut down the system to avoid damage to and/or the need for costly repairs to the sewing head assembly, as well as the garment being formed on the system. The folder wire itself is configured to direct and fold the top ply of the waistband portion of the garment over and about the elastic waistband, so that the bottom ply and top ply of the garment enclose the waistband therein. The folder wire is also shaped to plow out any curls or wrinkles formed in the bottom and top plies as they are advanced along the sewing path and helps to guide the folded waistband portion of the garment toward and into engagement with the reciprocating folder tongue of the downstream folder assembly. The folder tongue has a folding edge positioned between the top and bottom plies of the garment, and beneath the elastic waistband portion, which is moveable toward and away from a fixed edge hem folding guide simultaneous with the stitching of the hem through the top and bottom plies of the garment and the elastic waistband.

The improved waistband attachment system of the invention also includes a seam detection switch such that when the seam of the sewn hem of the waistband portion of the garment travels along a return portion of the sewing path, the switch is activated and the machine controller, or computer, operating the waistband attachment system is then signaled to count the number of stitches or time, equating to the distance traveled along the sewing path, as the garment travels from the seam detection switch to the needles, at which position, equal to the completion of the hem in the waistband of the garment, the puller roller releases the garment so that the stitches in the seam of the waistband can be condensed or oversewn to lock the stitches together. After a predetermined time delay, the puller roller then re-engages the garment and draws it forward so that a thread chain is provided for cutting such that the needles and loopers of the sewing head are in position to sew another hem in the next succeeding garment without having to be rethreaded.

A stacking assembly is mounted adjacent the sewing area of the waistband attachment system and is engaged during the sewing cycle as the sewing cycle is completed the garment is finished to assembly engage and remove the finished garment from the sewing area for inspection by the operator and stacking. The stacking assembly includes a main pivot arm that moves between a disengaging stacking position away from the sewing area of the waistband attachment system and a gripping or engaging position adjacent the sewing area of the waistband attachment system. A stacker bar is mounted below the main pivot arm at the disengaging or stacking position of the main pivot arm. The stacker bar includes a horizontally extending arm covering with a non-skid surface for receiving and holding the garments draped thereover and is vertically and rotationally adjustable to enable the operator to adjust the position of the stacker bar as desired for adjusting the size of the bundles of stacked garments. A rotary actuator is mounted to the framework of the waistband attachment system and includes a drive shaft connected to the main pivot arm rotating the main pivot arm in an arcuate motion over approximately 150° to 180°. The rotational actuator generally can include a pneumatic or hydraulic actuator, an electric motor, or similar device for rotating the pivot arm.

A pivoting gripper assembly is mounted to the main pivot arm, and includes a pair of grippers or garment clamps for engaging and holding the finished garment as the finished garment is removed from the sewing area at the end of a sewing cycle. The grippers are pivotable between a vertically extending, raised position when the main pivot arm is in its disengaging position and a horizontally extending lowered position when the main pivot arm is in its gripping or engaging position for gripping and removing the finished garments from the sewing area. Thus, as the sewing cycle is completed, the computer control system for the waistband attachment system signals the assembly to close the grippers about and engage the waistband of the finished garment. The main pivot arm then is moved through its arcuate path back towards its disengaging or stacking position above the stacker bar. At the same time, the gripper assembly is pivoted upwardly so that the grippers are moved to their raised position. The grippers hold the garment in a raised position with the garment slightly sagging so that the operator can inspect the seams and oversew area of the waistband of the garment to insure that the lines of stitching properly overlap and that there are not tabs that need to be trimmed or other defects that need to be fixed which would cause the garment to be rejected as a second. After the operator has loaded additional garment pieces in the waistband attachment system and restarts the system for sewing the next garment, the previously sewn garment is released by the grippers of the stacking assembly and stacked over the stacker bar on top of the previously finished garments.

It is therefore an object of this invention to provide an improved waistband attachment system, and method of sewing elastic waistbands to garments for efficiently and accurately aligning and folding the plies of a garment about an elastic waistband, which requires less skilled workers to operate and form quality finished work pieces.

It is another object of the present invention to provide an improved waistband attachment system, and method of sewing elastic waistbands to garments, which will improve the finished quality of the garments.

Yet another object of the present invention is to provide an improved waistband attachment system, and method of sewing elastic waistbands to garments which automatically expands and tensions the elastic waistbands to a predetermined size.

Still another object of the present invention is to provide an improved waistband attachment system and method of sewing elastic waistbands to garments which is readily adjustable for handling a wide range of elastic waistband sizes, as well as garment types and sizes.

Another object of the present invention is to provide an improved waistband attachment system and method of sewing elastic waistbands to garments which will detect the jamming of the sewing machine during operation, and will shut down the waistband attachment system prior to damaging either the sewing machine, or the garment.

Another object of the present invention is to provide an improved waistband attachment system and method of sewing elastic waistbands to garments which will minimize the formation of curls and tabs in the hem and seam of the sewn waistband.

Yet another object of the present invention is to provide an improved waistband attachment system which is simple in design and construction and is simple to use to produce consistent, high quality garments with the potential for defects being formed in the garments being minimized.

Another object of the present invention is to provide an improved waistband attachment system which will automatically fold and sew the plies of a garment about an elastic waistband and then remove and stack the finished garments.

Still another object of the present invention is to provide an automated sewing station having an automatic stacking assembly that will remove finished garments from the sewing station, display the garments for inspection and stack the garments in bundles.

These, as well as other objects, features, and advantages of the present invention will become apparent, therefore, upon reading the following specification, when taken in conjunction with the accompanying drawings.

DETAILED DESCRIPTION OF THE PREFERRED EMBODIMENTS

Figure 1:
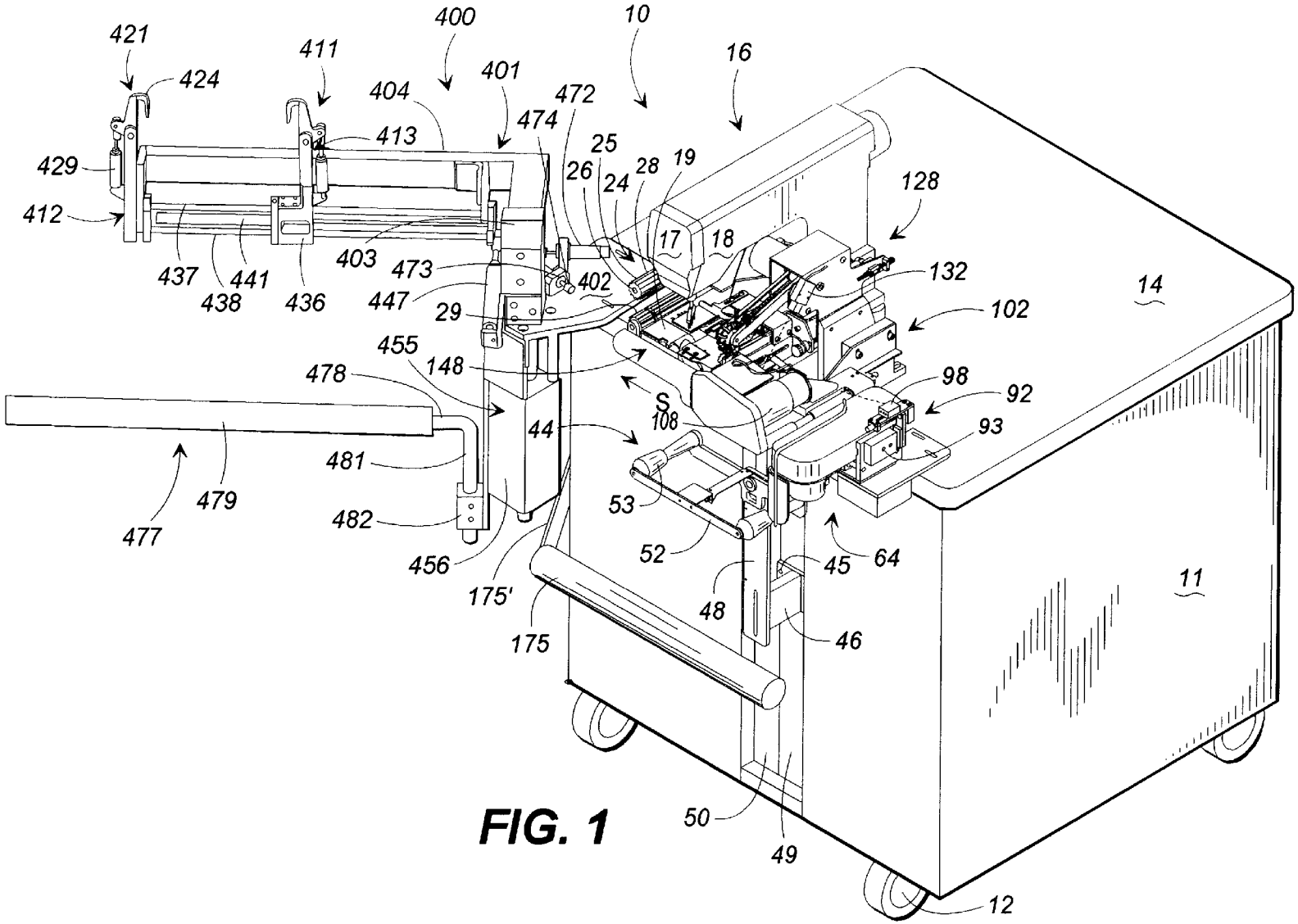
FIG. 1 is a perspective view of a preferred embodiment of the improved waistband attachment system of this invention.
Figure 2:
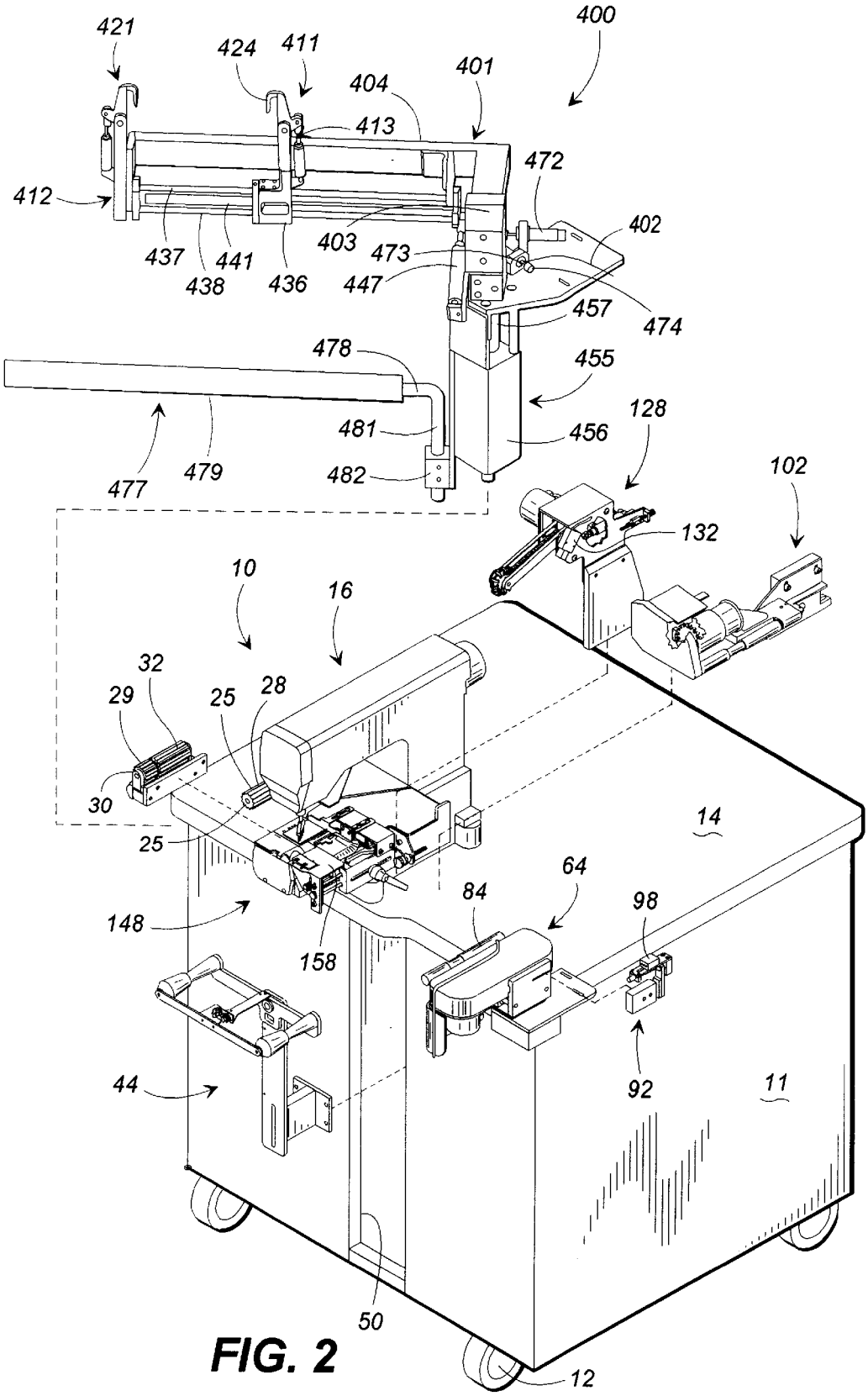
FIG. 2 is a partially exploded perspective view of the waistband attachment system of FIG. 1.
Figure 3:
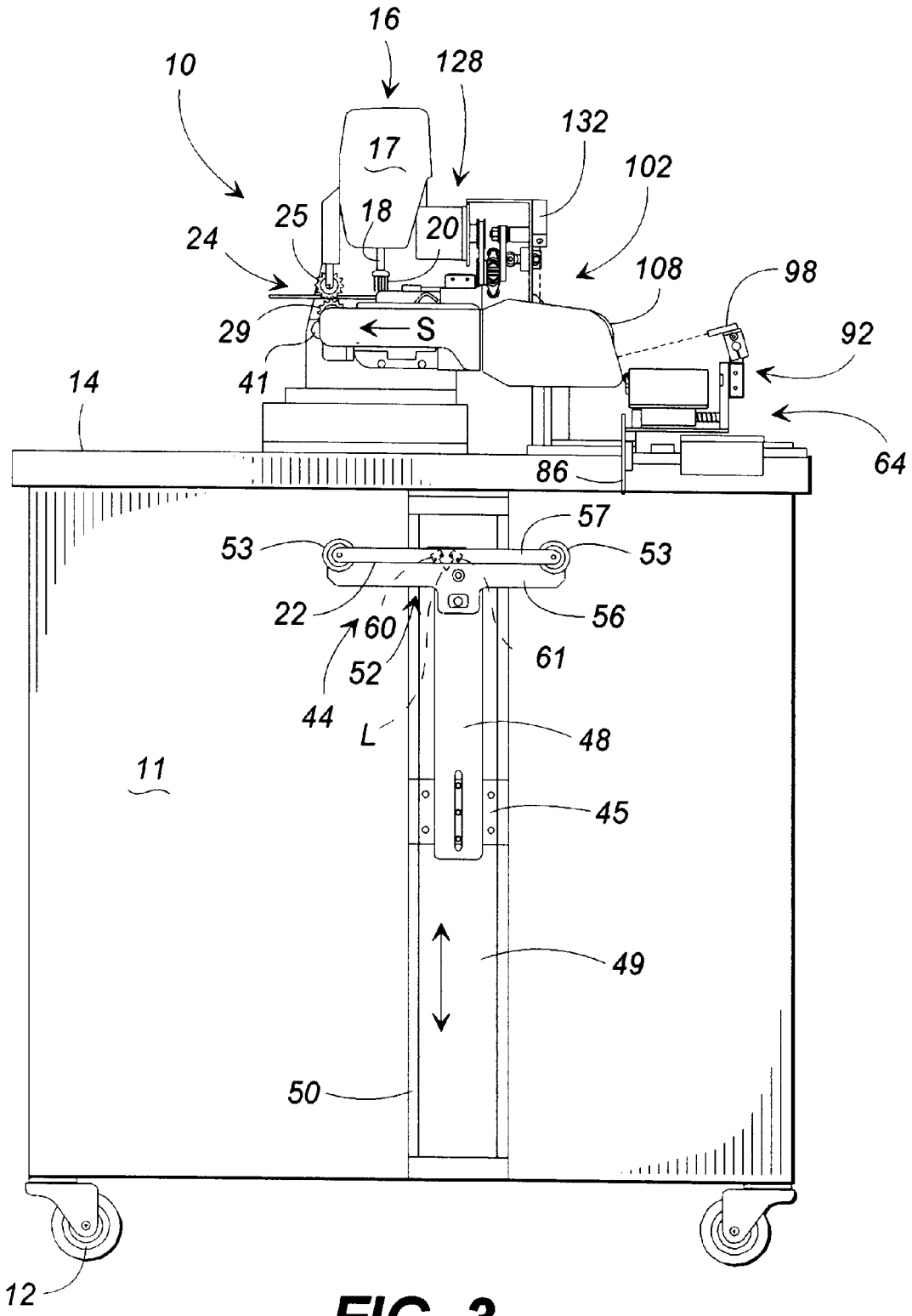
FIG. 3 is a front elevational view of the waistband attachment system of FIG. 1.

Referring now to the drawings, in which like reference numerals indicate like parts throughout the several views, FIGS. 1–3 illustrate a first embodiment of a waistband attachment system 10, hereinafter referred to as the "attachment system", for sewing garments, such as pants, skirts, and shirts, or tubular workpieces such as bags or pillowcases. The attachment system includes a cabinet style framework 11 having a plurality, in this instance four, rollers 12 rotatably mounted thereto so that attachment system 10 can be readily moved to any desired location. Situated atop frame work 11 is a generally horizontal work table 14.

The waistband attachment system 10 includes a sewing head assembly 16 having a sewing head 17 with a series of sewing needles 18 positioned on work table 14 at a sewing area 19, through which a sewing path, denoted by the reference character "S" extends. An elastic waistband (not illustrated), and the waist portion of a garment such as a shirt body or a pair of pants (not illustrated) to which the waistband is to be attached are moved along the sewing path and through the sewing head 17 of the sewing head assembly for attaching the waistband to the garment. A puller roller assembly 24 is positioned immediately downstream of the sewing head assembly and includes a puller roller 25 and an opposed compensation roller 29 with which the puller roller is operably engaged. The elastic waistband and the garment to which the waistband is being attached are drawn along the sewing path, and through the sewing area 19, by puller roller assembly 24.

As illustrated in FIGS. 1–3, a waistband expansion assembly 44 is mounted to the front of the framework 11. The elastic waistband is passed about and engaged by the waistband expansion assembly and is expanded to a predetermined size as described in greater detail below. Situated downstream of waistband expansion assembly 44, and upstream of sewing head 17, is a bottom edge guide assembly 64, which includes a bottom edge guide detector assembly 92. Immediately downstream of the bottom edge guide assembly is a folder wire assembly 102 constructed and arranged to form the folded waistband of the garment by moving a top ply of the waist portion of the garment about the elastic waistband such that the elastic waistband is sandwiched between the top ply and an opposed bottom ply of the garment. This is illustrated schematically in FIGS. 19A–D. Once the top and bottom plies of the garment have been folded about the elastic waistband, the now folded garment is advanced along the sewing path underneath a top edge guide assembly 128 toward a downstream folder assembly 148.

The bottom edge guide assembly 64 is constructed and arranged to overfeed the unfolded waistband portion of the garment into folder wire assembly 102, and from there into folder assembly 148 such that the elastic waistband is fully enclosed in the top and bottom plies of the garment. Folder assembly 148 includes a reciprocating folder tongue 158, moving into and out of a fixed edge hem folding guide 169, in known fashion for completing the formation of the fold or hem in the garment, whereupon the needles 18 of sewing head 17 will stitch a hem in the waistband portion of the garment, and through the elastic waistband. The bottom edge guide assembly 64 overfeeds the waistband portion of the garment to both the folder wire assembly and folder assembly. The top edge guide assembly 128 thereafter aligns the edge of the fabric with the target position. The top guide will predominantly pull the fabric away from the knife while aligning the fabric edge to the target position defined by the trim detector. Because the bottom guide is designed to overfeed the fabric while the top guide pulls the fabric away, this causes the top and bottom plies to be drawn snugly about the elastic waistband forming a quality hem, once sewn into the garment.

In the embodiment of attachment system 10 shown in FIG. 1, the attachment system also includes a stacking assembly 400 constructed and arranged for movement from a first, disengaging or stacking position at rest, disposed adjacent the framework, a second, engaging or gripping position (not illustrated) about the sewing area. The stacking assembly engages the waistband portion of the garment and removes the finished garment from the sewing area for stacking as part of a garment bundle for removal to further processing stations.

Figure 9B:
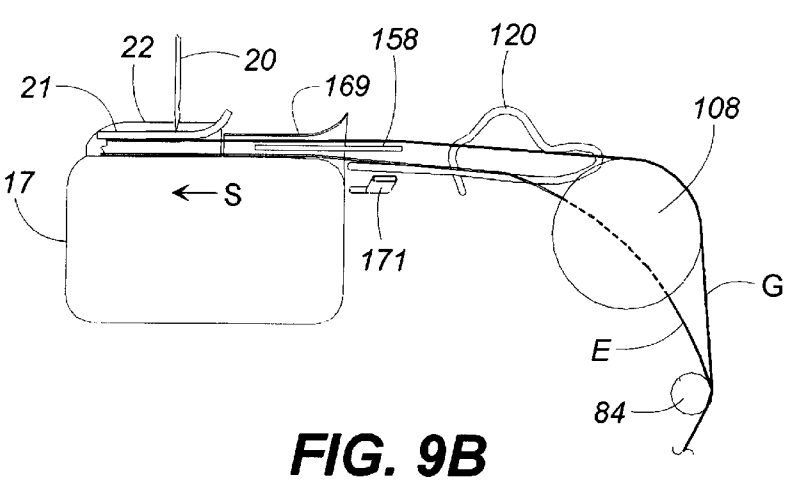
FIG. 9B is a schematic side elevational view of the folder wire and folder assembly.
Figure 9C:
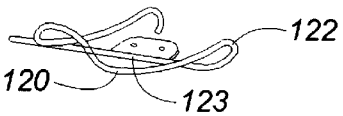
FIG. 9C is a perspective view of the folder wire of FIGS. 9A and 9B.
Figure 9A:
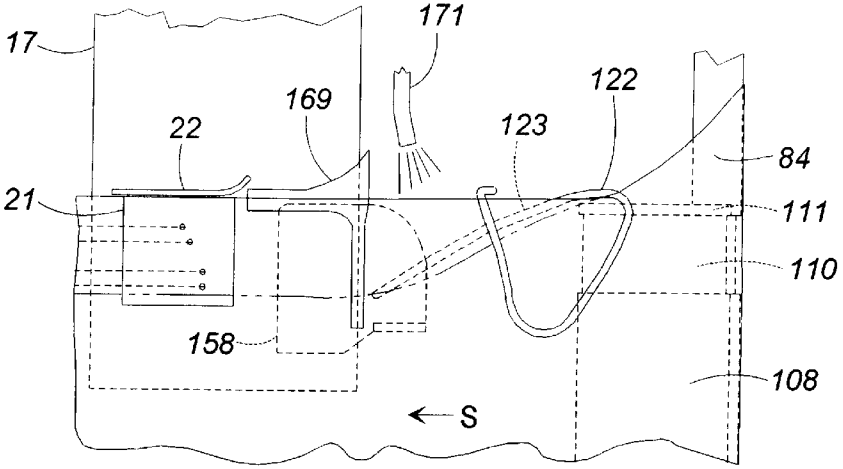
FIG. 9A is a schematic top plan view of the folder wire and folder assembly.

Referring now to FIGS. 1–3, and 9A–9B, sewing head assembly 16 is illustrated in greater detail. The sewing head assembly 16 includes a conventional sewing head 17, for example those sewing machines manufactured by Pegasus, Juki, Yamato, and others, suitable for use in sewing a hem in a garment. As such, the sewing head will include at least one push rod to which at least one needle 18, and in this instance four needles, are attached for forming four parallel lines of stitching (FIG. 9B) along the waistband, or hem, or the garment. In known fashion, the sewing head assembly will also include a presser foot 21, illustrated in FIGS. 9A and 9B, which works in conjunction with the known type of sewing machine feed dogs, none of which are illustrated, for advancing the garment along the sewing path through the sewing area 19 (FIG. 1). However, the primary means of garment transport along the sewing path is provided by puller roller assembly 24. Also, and as shown in FIGS. 9A, 9B, and in FIG. 11, sewing head assembly 16 includes a fixed edge, or stationary edge guide 22 positioned along the sewing path such that the folded edge of the waistband portion/hem of the garment will be guided thereagainst.

The puller roller assembly 24 is illustrated further in FIGS. 1–4. Puller roller assembly 24 (FIG. 1) includes a powered, rotatable, elongate toothed puller roller 25 having a first segment 26, and a second segment 28. First segment 26 will be received against compensation roller 29, and will pull the "body", or the unfolded portion of the garment along the sewing path, whereas the second segment 28 of the puller roller assembly will be separately received against the compensation roller and will sandwich the folded and sewn hem therebetween. As illustrated in greater detail in FIG. 4, compensation roller 29 is a toothed, elongate roller that includes a first segment 30 opposed to first segment 26 (FIGS. 1, 4) of the puller roller, and an independent second segment 32 (FIG. 4) opposed from second segment 28 (FIG. 1) of the puller roller. The first and second segments of compensation roller 29 (FIG. 4) rotate independently of one another, and each is an idler, or driven roller, driven by the respective segments of the puller roller 25 (FIG. 1) for engaging the cloth or textile material of the garment as well as the elastic waistband therebetween, and advancing the garment along the sewing path.

Figure 4:
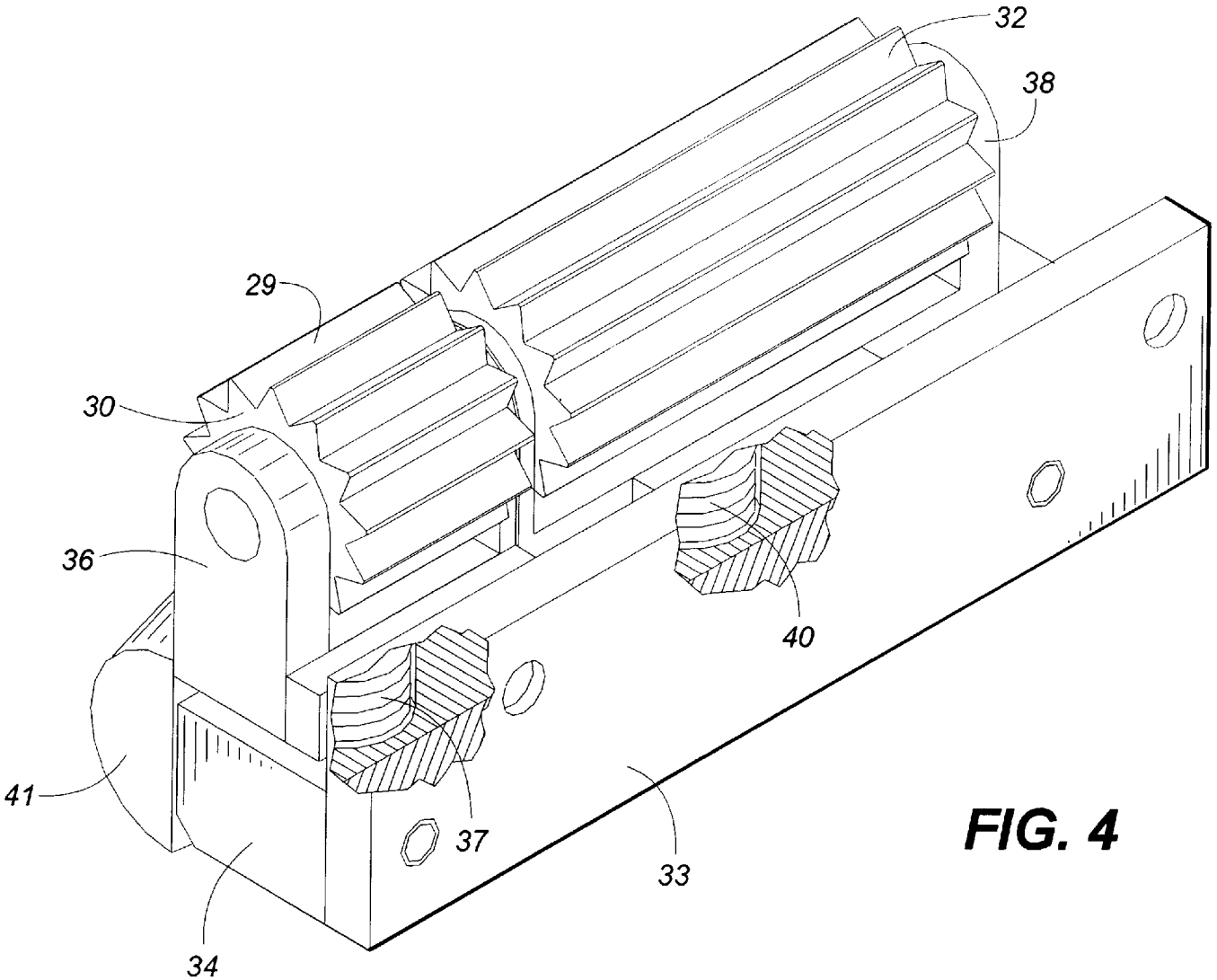
FIG. 4 is a perspective view of the compensation roller used with the puller roller assembly of the waistband attachment system of FIG. 1.

As shown in FIG. 4, compensation roller 29 has a mounting plate 33 for mounting to sewing head assembly. Extending perpendicularly from the mounting plate is a base plate 34, on which a first carrier 36 and a second carrier 38 are individually and rotatably supported. Both of these carriers, corresponding to the two segments of the compensation roller, are "free-floating" such that if a pocket, for example, is passed tlherebetween, and as puller roller is fixed in position, compensation roller 29, and in particular either first or second segments 30, 32, will be urged against the force of compensation springs 37, 40, respectively, to allow the garment to pass therethrough without being otherwise skewed or pulled at an angle due to the mismatch in the thickness of the hemmed portion of the garment, for example, with respect to the body of the garment. So constructed, compensation roller 29 of the puller roller assembly ensures that the garment will be pulled in a smooth, steady movement along the sewing path, and will not otherwise be skewed or caught which may result in the garment moving off of the attachment system.

The puller roller assembly 24 also includes a stationary profiled elastic edge guide 41 (FIG. 3) having a notched profile similar to profiled rollers 53 (FIG. 5) of waistband expansion assembly 44. The function of the profiled edge guide 41 is to urge the elastic to run against a fixed guide 22, while the function of the profile of rollers 53 is to center the elastic waistband so that it will not tend to shift or walk off of the rollers, or elastic edge guide, as it progresses along the sewing path.

The first and second segments 26, 28 (FIG. 1) of puller roller 25, and the first and second segments 30, 32 (FIG. 4) of compensation roller 29 are preferably made of DELRIN plastic, although nylon, polyvinylchloride, and other similar plastics will suffice. Moreover, the edge guide and profiled rollers can also be fashioned of a metallic material, for example a polished steel surface, if so desired. A slight amount of surface friction will be created such that as the elastic waistband moves along the sewing path it will rotate rollers 53 (FIG. 5), as well as bottom edge guide idler roller 84 (FIGS. 6B, and 8), and top roller 108 (FIGS. 1 and 8) in the direction of the sewing path to assist in carrying the garment along the sewing path.

Figure 5:
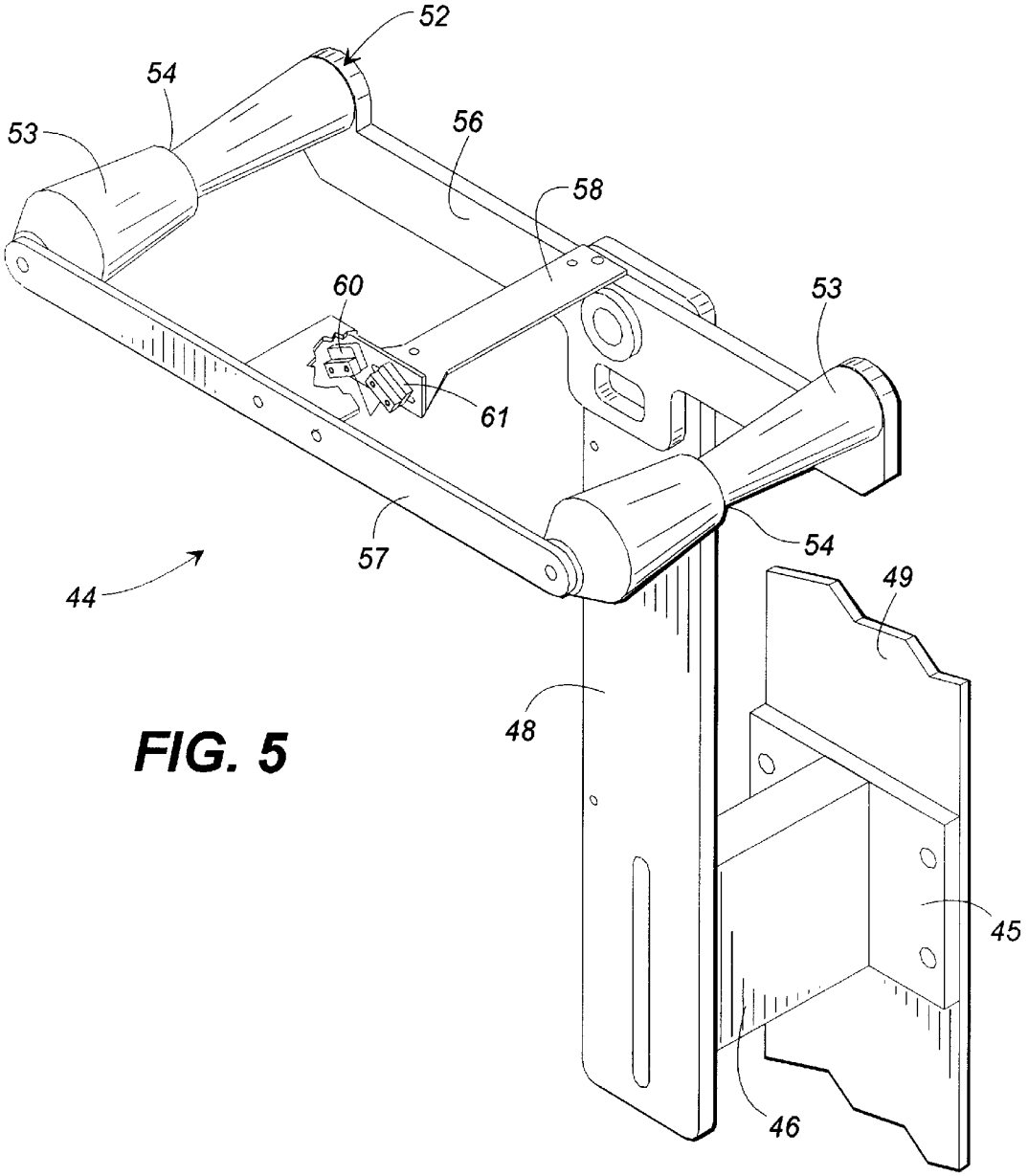
FIG. 5 is a perspective view of a waistband expansion assembly used with the waistband attachment system of FIG. 1.

The waistband expansion assembly 44 is illustrated in FIGS. 3 and 5. The waistband expansion assembly includes a mounting plate 45 from which a first arm 46 extends, with a second arm 48 attached thereto. Mounting plate 45 is fastened to an elongate and endless drive belt 49 (FIG. 3), situated within an opening defined in the face of framework 11 of the attachment system. A linear actuator, for example a pneumatic cylinder or a motorized mechanical drive could also be used, if desired. Affixed to the uppermost end of second arm 48 is a carrier 52 on which the two profiled rollers 53 described above are separately and rotatably supported. As shown in FIG. 5, each profiled roller includes a frustoconical profile at each of its respective ends and facing inwardly toward one another to define a notch 54 in the periphery of the roller for the purpose of centering the elastic waistband thereon as it is passed about the waistband expansion assembly.

Carrier 52 has a first side piece 56 pivotally fastened to arm 48, with a spaced parallel second side piece 57, the two side pieces being fastened to one another by an elongate cross-piece 58. Each of the profiled rollers 53 is rotatably supported on side pieces 56 and 57 by a pin or axle extending from the ends of each roller into an opening defined within the respective side pieces, such that the profiled rollers are journaled for rotation thereon. Although not illustrated herein, it is anticipated that, and if desired, profiled rollers 53 also could be provided with needle bearings or other suitable roller bearings.

As shown in FIGS. 3 and 5, a photo, or light, emitter 60 which emits a focused beam of light is positioned on the underside of cross-piece, such that the beam of light emitted thereby is aimed at the inside surface of the garment once it is passed about profiled rollers 53. The beam of light emitted from the emitter 60, as shown by the dashed lines L in FIG. 3, will reflect off of the surface of the garment and be received by a receiver 61, also situated on the underside of cross-piece 58 (FIG. 5), and angled such that it will receive the beam of light reflected off of the surface of the garment when the elastic waistband is properly sized. Receiver 61 will emit a signal, as best shown in FIG. 14, to the control system of the attachment system, such that the operation of waistband expansion assembly 44 can be automated.

In use, it is anticipated that an operator will take the continuous looped elastic waistband and pass it about profiled rollers 53 of the waistband expansion assembly, edge guide 41 of the puller roller assembly, bottom edge guide idler roller 84 of the bottom edge guide assembly, top roller 108 of the folder wire assembly, and folder tongue 158 of folder assembly 148, along the sewing path. Thereafter the system will automatically, or by the operator engaging either a foot switch (not illustrated) or a thumb switch (not illustrated), signal the control system 190 (FIG. 15) to power a drive motor 49*a* (FIG. 15) and move drive belt 49 in a downward direction for expanding the elastic waistband to a predetermined size. The predetermined size of the waistband will be stored within the control system 190. Within the memory of the control system, a number of parameters dealing with the size of the garment to be formed on the attachment system are stored, such that when it is known that a certain sized garment is being processed, the waistband expansion assembly will move to a predetermined position in a direction downward and away from sewing head assembly 16. If, however, it is desired that the attachment system automatically move the expansion assembly to a desired expansion position, the operator may select automatic expansion as an option, whereupon once the waistband is passed over the profile rollers and the foot/thumb switch operated, the expansion assembly will begin to move downward away from the sewing head assembly until such time as the beam of light emitted by emitter 60 is received by receiver 61 and signaled to the control system, whereupon the expansion assembly will stop and hold in this position for the entirety of the sewing cycle. At this point, the waistband is taut with all the slack removed therefrom, without the waistband being stretched. Once the garment is completed the expansion assembly automatically moves upward so that the garment can be removed from the attachment system.

After the elastic waistband, and the garment, are moved along the sewing path over the waistband expansion assembly, they are moved toward and through a bottom edge guide assembly 64 positioned upstream of the sewing head assembly as illustrated in FIGS. 1–3. The bottom edge guide assembly has a carrier plate 65 (FIGS. 6A and 6B) mounted to the work table of the system. A pneumatic cylinder 65' is provided for moving the bottom edge guide assembly into engagement with bottom edge guide idler roller 84, shown in FIG. 6B, to pinch the fabric of the garment therebetween at the start of the hemming operation. Once the hemming of the garment is complete, the pneumatic cylinder will move the bottom edge guide assembly away from the garment for removing the garment from the attachment system.

Figure 6A:
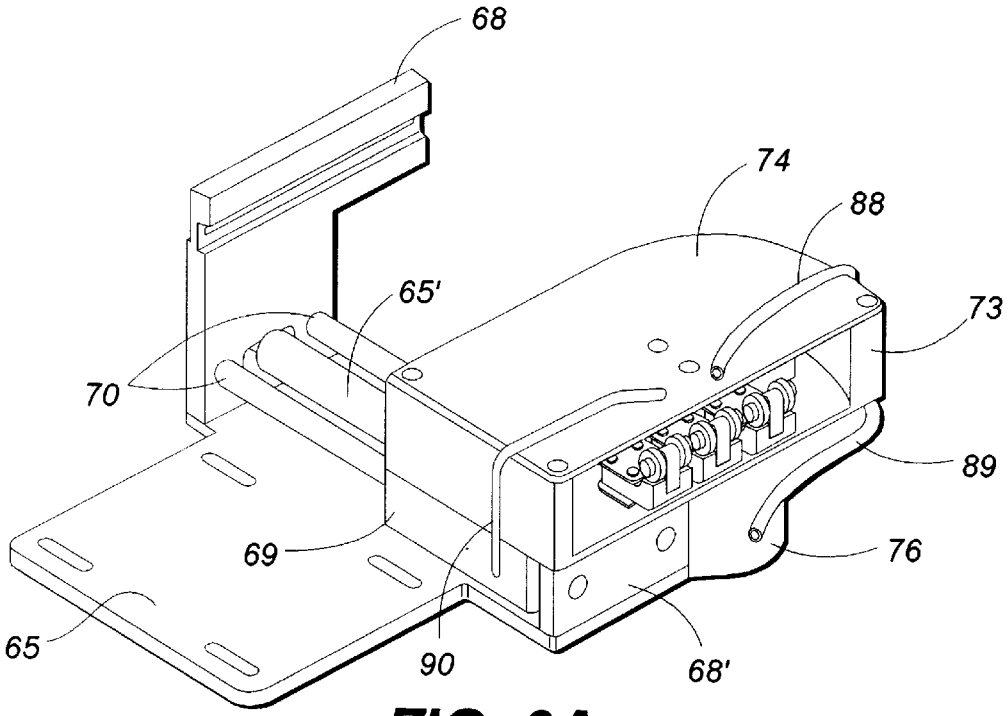
FIG. 6A is a front perspective view of a bottom edge guide assembly used with the waistband attachment system of FIG. 1.
Figure 6B:
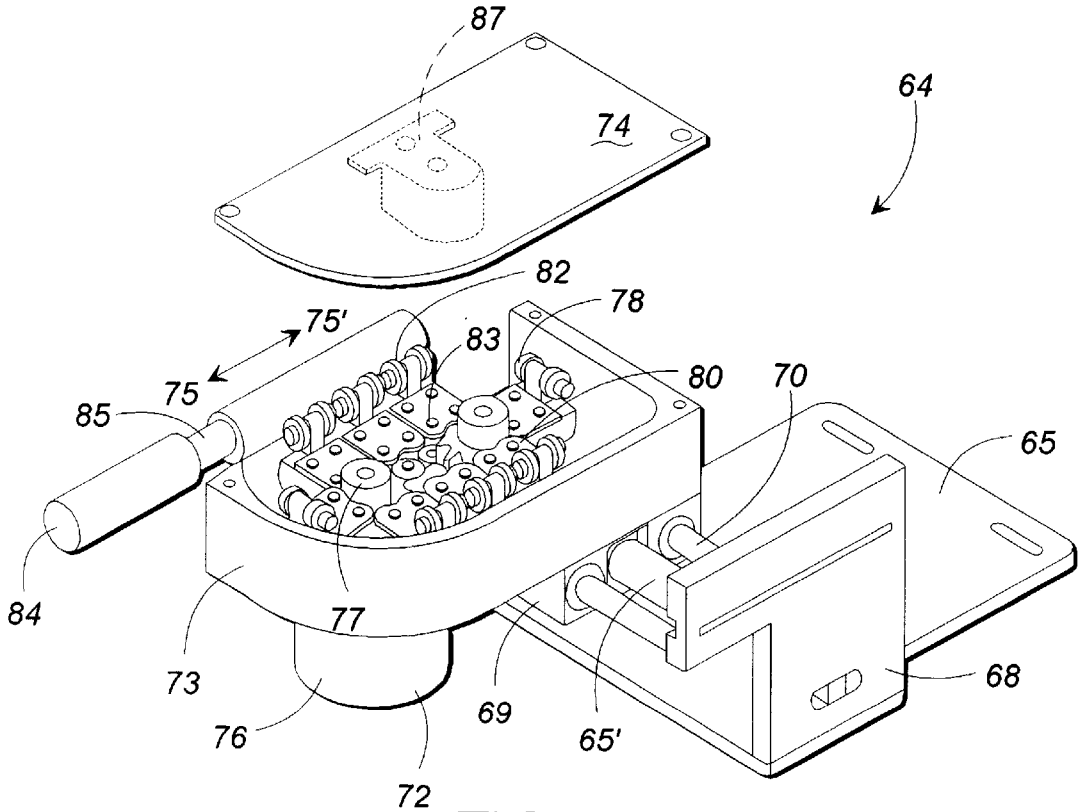
FIG. 6B is a partially cut away rear perspective view of the bottom edge guide assembly of FIG. 6A.
Figure 7:
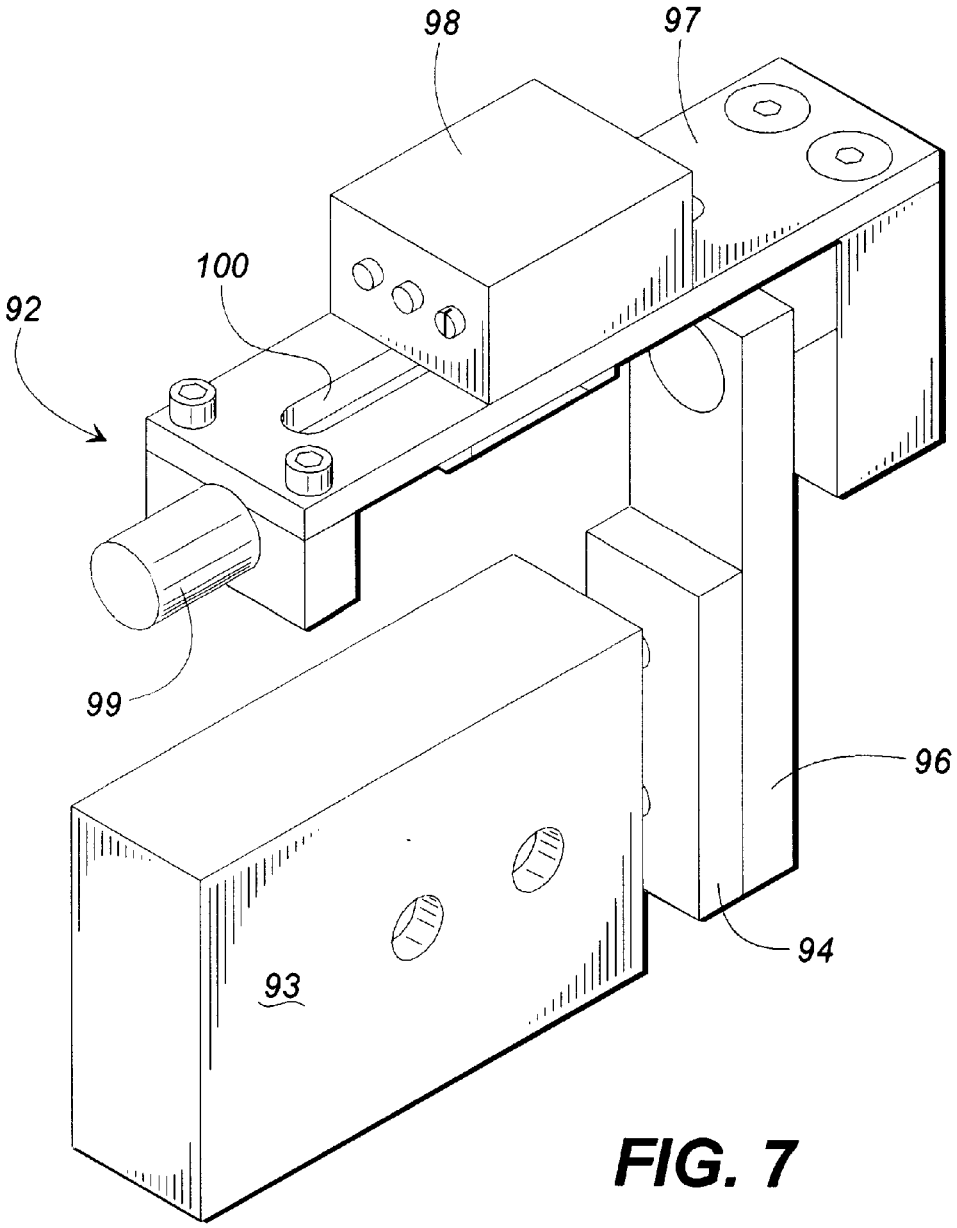
FIG. 7 is a perspective view of a bottom edge guide detector eye assembly used with the bottom edge guide assembly of FIGS. 6A and 6B.

Referring to FIG. 6B, a first horizontal mounting plate 66 is fastened to the cylinder 65' with a second vertical mounting plate 68 extending upwardly therefrom. Supported on mounting plate 66 is a rail guide block 69, having a pair of spaced guide rail openings defined therein for receiving one each of a pair of spaced parallel guide rails 70, the guide rails being affixed to mounting plate 68. Cylinder 65' is attached at one end to mounting plate 68 and at its opposite end to rail guide block 69,which moves along guide rails 70. Cylinder 65' is used to move the bottom edge guide assembly into and out of engagement with edge guide idler roller 84.

Still referring to FIGS. 6A and 6B, the bottom edge guide assembly includes a base plate 72 affixed to rail guide block 69, having a housing 73 with a detachable cover 74 received thereon, to which a drive motor 76 is fastened. Drive motor 76 has an elongate drive shaft extending upwardly into the housing, on which a drive sprocket 77 is fastened for rotating about the axis of the drive shaft. A spaced idler sprocket 78 is also rotatably supported on base plate 72, and an endless drive chain 80 (FIG. 6B) is passed about the drive and idler sprockets, having carriers 81 with pairs of guide wheels 82, and may be moved in either direction laterally across the sewing path by drive motor 76 as indicated by arrows 75 and 75'. It is anticipated, however, that in its preferred mode of operation, drive motor 76 will move drive chain 80 in the directions of arrows 75 and 75', such that the carriers 81 fastened thereto, and the guide wheel 82 supported on each carrier, respectively, are moved in that direction for guiding, or overfeeding, the iunfolded waistband portion of the garment into the folder wire assembly 102 (FIG. 1), and in turn into the folder assembly 148.

Each one of carriers 81 (FIG. 6B) is separately affixed to drive chain 80, and is carried thereby as the drive chain is rotated about the drive and idler sprockets by drive motor 76. Each pair of guide wheels 82 is free to rotate and is not otherwise powered. Each pair of guide wheels 82 will be independently biased into engagement with bottom edge guide idler roller 84, in the normal, or default position of the bottom edge guide assembly by compensation springs 83. Thus, each pair of guide wheels can be independently moved such that as a seam passes under one pair of guide wheels, that pair can be moved to enable the seam to pass thereunder while the remaining pairs of guide wheels maintain their engagement with the garment.

The bottom edge guide idler roller is formed from a plastic such as DELRIN and is split into 2 halves. The halves are telescoping in nature, creating a notch 85 defined in the bottom edge guide idler roller for receiving the elastic waistband as it is passed about the respective rollers of the attachment system, prior to the placement of the garment about the same rollers and in overlying relationship with the elastic waistband. The bottom edge guide idler roller is easily adjustable to accommodate a wide range of sizes of elastic waistbands as necessary to enable the system to be quickly and easily adjusted to accommodate changes in sizes of the garments being processed.

As indicated in FIG. 6B, a bearing guide 87 (shown in dashed lines) is mounted to the underside surface of the cover plate 74. The bearing guide is positioned behind the chain 80 and acts as a bearing surface for the carriers 81 to maintain the chain substantially taut and prevent the carriers and chain from buckling or shifting inwardly and losing contact with the fabric when a seam passes thereunder.

As shown in FIG. 6A, an array of three blowers 88, 89 and 90 is positioned on the face of the bottom edge guide assembly outwardly of guide plate 68 and past which the garment will pass. The first of these is top uncurl blower 88 which will blow across the top of the unfolded garment as it is passed between the guide wheels 82 and idler roller along the sewing path. The bottom uncurl blower 89 will blow underneath the guide wheels 82 engaged with the idler roller, to blow any curl out of the garment before it is passed therebetween. The third blower, body uncurl blower 90, is provided for further blowing incoming ripples or pleats out of the body of the garment as it is passed about the bottom edge guide assembly along the sewing path. Each of blowers 88–90 will be provided with a pressurized stream of air from a conventional source of compressed/pressurized air used to operate the various pneumatic components of attachment system 10. As shown schematically in FIG. 15, blowers 88–90 will be operated by a solenoid valve (not illustrated) in communication with the control system 190, and in particular with an air I/O card 202 provided as a part thereof, the signals being passed through a signal path 203 to the respective solenoid valve which actuates these three blowers.

As shown in FIGS. 1–3, and 7, the bottom edge guide assembly also includes a bottom edge guide detection eye assembly 92 supported on mounting plate 68. The bottom edge guide detection eye assembly includes a position cylinder 93 (FIG. 7), a pneumatic cylinder mounted to plate 68, and having an extensible foot 94 mounted thereon for reciprocating movement transverse to the sewing path. Fastened to foot 94 is a first upright arm 96, to which a second arm 97 is attached. A bottom edge guide detector, comprising an eye or sensor, 98 is positioned on second arm 97, and preferably comprises a photosensor aimed toward the garment as it passes between the guide wheels 82 (FIG. 6B) and idler roller 84 of the assembly for detecting, and tracking the unfinished waist edge W (FIGS. 19A–D) of the garment. The bottom edge guide detector has a fine position adjustment screw 99 (FIG. 7) that permits movement of the eye within the confines of travel slot 100 defined within second arm 97 for fine tuning the position of the detector 98.

For reasons described in greater detail below, during a pre-sew portion of the sewing cycle, the top ply of the garment is folded about the elastic waistband and moved into the folder assembly, after which the stitching of the hem will start. The unfinished waist edge "W" (FIGS. 19A–D) is positioned in alignment with knife 170 of the folder assembly, but is not yet fed into the knife. Once the sewing of the hem starts and as the garment progresses along the sewing path, position cylinder 93 (FIG. 7) will move arm 96 transversely of the sewing path, and toward work table 14, such that bottom edge guide eye 98 will be moved in the same direction, which in turn will signal control system of the attachment system and in turn then signal drive motor 76 (FIG. 6B) for operating chain 80 such that the chain will be moved in the same direction for the purpose of "overfeeding" the unfolded garment into the folder wire and folder assemblies, respectively. As this happens, therefore, the unfinished waist edge of the garment is progressively moved into the knife, but does so without creating a tab either at the beginning, or at the end, of the waistband sewing cycle.

Figure 8:
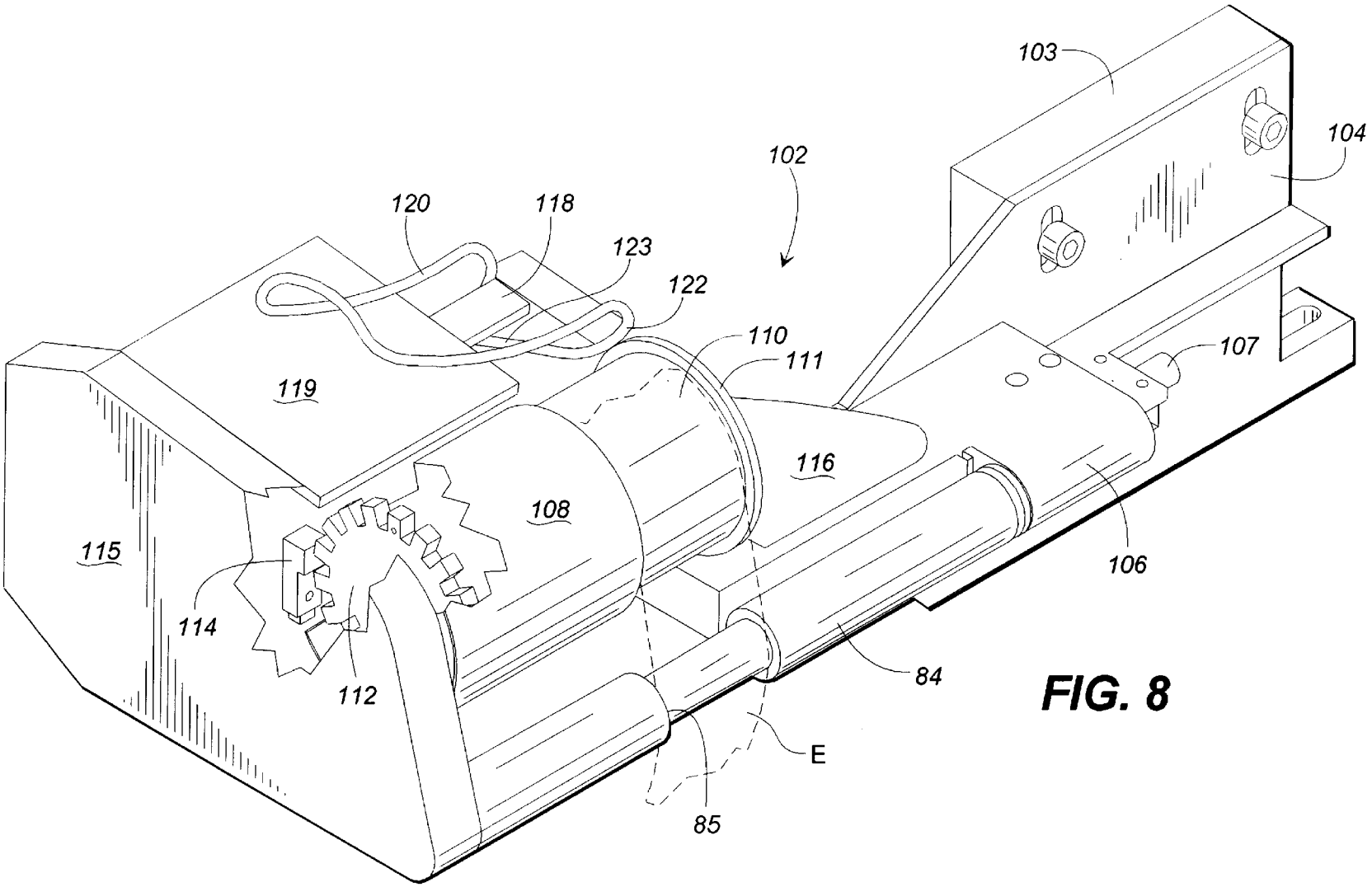
FIG. 8 is a perspective view of the bottom guide idler roller and top roller, and folder wire used with the waistband attachment system of FIG. 1.

As shown in FIGS. 1–3, a folder wire assembly 102 is positioned atop work table 14 downstream of the bottom edge guide assembly. Referring to FIG. 8, folder wire assembly 102 has a mounting plate 103 which is secured directly, or indirectly, to the work table of the attachment system with a carrier affixed to the mounting plate. A housing 106 is positioned on the carrier, with a position adjustment screw 107 provided for adjusting the width of notch 85 defined in bottom edge guide idler roller 84 as well as for adjusting the position of a cloth guide 116, and of folder wire 120 along the sewing path. Bottom edge guide idler roller 84 is formed in two pieces, the first piece, which includes notch 85, is held in a fixed position with respect to the sewing path on end plate 115. The position adjustment screw can be manually rotated for moving the second portion of the bottom edge guide idler roller journaled on housing 106 across the sewing path to adjust the size of notch 85 along the sewing path for handling elastic waistbands of a range of desired sizes. When notch 85 is opened up for handling a wider elastic waistband, for example, cloth guide 116, and folder wire 120 will also be moved inwardly with the expansion of the notch 85 so that the topmost edge of the waistband, about which the hem will be folded, is aligned with the folder wire 120.

Bottom edge guide idler roller 84 is rotatably supported on housing 106 and end plate 115 of the folder wire assembly. Folder wire assembly 102 also includes a conically-shaped cloth guide or horn 116 positioned at the end of top roller 108 facing work table 14, for the purpose of helping to guide the unfolded waist edge of the garinent toward and into folder wire 120 to initiate the folding of the top ply of the garment about the waistband and guide the garment toward the downstream folder assembly 148 (FIG. 1). As shown in FIG. 8, the edge of idler roller 84 positioned closest to end plate 115 is in alignment with the edge of notch 110 formed in top roller 108, all of which are in alignment with the knife 170 of the sewing head assembly 16 along the sewing path. In this manner, a base or home position for at least one continuous edge of the elastic waistband is always maintained, this being the edge portion of the elastic waistband about which the top ply of the garment will be folded, and along which the waist edge will be trimmed by knife 170.

The folder wire assembly also includes a rotatable top roller 108 (FIG. 8), which is shown as an idler roller. However, top roller 108 may be independently powered for rotation in the direction of the sewing path when, and as desired, as may be bottom edge guide idler roller 85. Top roller 108 has a notch 110 defined therein, with an end flange 111 for receiving the elastic waistband, shown in broken lines, and is adjustable to accommodate changes in sizes of the elastic waistband as desired. It is anticipated that the elastic waistband, after having been expanded to its predetermined size by waistband expansion assembly 44, will have sufficient tension for rotating bottom edge guide idler roller 84, top roller 108, as well as profiled rollers 53 (FIG. 1) of the waistband expansion assembly, as the elastic waistband is moved along the sewing path by puller roller assembly 24.

Top roller 108 (FIG. 8) is shown partially cut away to reveal a timing disc, or a toothed timing gear, having a radially spaced series of teeth projecting outwardly therefrom, which extend to just below the surface of the top roller to form a series of timing marks or indicia about the periphery of the top roller. It is anticipated that top roller 108, as will be bottom edge guide idler roller 84, will be constructed of a plastic such as DELRIN, or other suitable plastic, and thus the teeth of the metal timing disc/gear can be detected through the plastic of the top roller, such that as it is rotated past a proximity sensor 114 held in a fixed position with respect to the top roller, the proximity sensor will detect an on/off state representative of the rotation of the top roller. If the attachment system should become jammed during the sewing of the waistband to the garment, proximity sensor 114 will detect that top roller 108 has stopped rotating and will emit a system stop signal to control system 190, illustrated in FIG. 14, to automatically stop the attachment system.

A seam detection switch 118 (FIG. 8) is provided at the folder wire assembly 102, which comprises an elongate lever pivotally supported on a housing 119, itself supported on end plate 115. A proximity sensor, a photo eye, or any other suitable type of sensor (not shown) is positioned underneath the end of seam detection switch 118 received within the housing. When the seam of the folded and sewn hem is returned along the sewing path toward the sewing head, it will strike seam detection switch 118 and will move it from a position in which it is projecting into the sewing path, as shown, into a position extending along the sewing path whereupon such movement will be detected by the appropriate sensor held within housing 119, which will in turn emit a seam detection signal to control system 190 as shown schematically in FIG. 14. Once this occurs, the control system will read the motor position of sewing head 17, and will then perform a stitch count, by counting the revolutions of the sewing head, one revolution being one stitch, which in turn translates to a distance as the number of stitches per inch will be known, and will measure the movement of the seam along the sewing path until it reaches a predetermined position beneath needles 18 (FIG. 3), whereupon puller roller 25 will disengage itself from compensation roller 29 while the needles 18 continue to reciprocate such that an over-sewn or condensed stitch is sewn at the seam for locking the threads to the garment so that the seam, and in turn the hem, will not pull out. It is also possible to perform this control based upon a timed delay instead of a stitch count.

After the elastic waistband has been passed over notch 85 (FIG. 8) of the bottom edge guide idler roller, and the notch 110 of top roller 108, it is passed over seam detection switch 118, under folder wire 120, and along the sewing path toward and through sewing head assembly 16 (FIG. 3), as well as being passed through the puller roller assembly 24, and about the waistband expansion assembly 44. Thereafter, the unfolded waist edge portion of the garment is passed over the elastic waistband. It is anticipated that as the garment is placed by the system operator on the folder wire assembly, a surplus of the waist edge portion of the garment will be gathered beneath the folder wire.

Folder wire 120 is shown in greater detail in FIGS. 8, 9A–9C. Folder wire 120 is geometrically shaped to allow for the rapid and controlled folding of the top ply of the garment about the elastic waistband, and onto an overlying bottom ply, while also acting to prevent the formation of wrinkles or curls in the garment. As shown schematically in top plan in FIG. 9A, the geometric configuration of the folder wire can best be described as a compound bend. A leading portion of the compound bend, identified as a first segment 122, forms a leading edge portion of the folder wire which starts a gentle vertical ramp, and a gradual horizontal plow which makes contact with the unfolded waist edge of the material at one. A second segment of the folder wire, designated as 122, engages the underside of the folded waistband portion, or hem, of the garment. Both segments 122 and 123 are designed to progressively and positively urge the garment material to fold under, i.e. by moving the folded waistband portion of the garment about the elastic waistband, in a smooth and rapid manner. The folder wire is designed so that a small amount of friction will be created in the direction perpendicular to the wire against the cloth of the garment as it passes thereunder, thus tending to plow or smooth out any ripples or humps from the folded portion of the material. The wire has an upward vertical ramp designed to gradually lift the material up to the level of the sewing head's bed, i.e. the level of folder tongue 158, and to keep the folded waistband portion of the garment under control until the hem is trapped between the folder tongue, the fixed edge hem folding guide 169, and sewing head 17 (FIG. 9B). Additionally, the unique configuration of folder wire 120 helps to neatly finish the hem fold as the already sewn portion of the hem comes back around and through the folder wire to ensure that positive control is maintained over the folded edge of the garment at all times. Although not shown to scale in FIGS. 8–9C, it is anticipated that the entire length of folder wire assembly 102 along the direction of the sewing path is approximately 8 inches, which provides for a compact folding assembly.

The top edge guide assembly 128 is illustrated in FIGS. 1–3, and 10A and 10B, and is positioned downstream of the folder wire assembly 102 and along the sewing path upstream of folder assembly 148. Top edge guide assembly 128 (FIG. 10A) will take away any surplus of the material overfed into the folder wire assembly, and thus the folder assembly 148 for the purpose of further controlling the position of the waist edge extending along the folded top ply of the garment with respect to the knife 170 of the sewing head assembly. Top edge guide assembly 128 includes a mounting plate 129 fastened, directly or indirectly, to work table 14. The mounting plate supports a frame, or housing 130 on which an elastic detection sensor 132 is mounted. As best shown in FIGS. 1 and 3, elastic detection sensor 132 is aimed toward the sewing path, and is in particular aimed toward where the elastic waistband should be situated along the sewing path. If an elastic waistband is not detected by this sensor, then the operation of the appropriate foot switch, or thumb switch will not start machine operation, functioning as a fail safe mechanism. Moreover, once the elastic waistband is looped about the components of the attachment system, and the elastic waistband is detected by the elastic detection sensor 132, the operator can load the garment and enter the appropriate instructions through data display and entry device 200 (FIG. 14) to operate waistband expansion assembly 44, i.e. to expand the waistband to its proper size, upon changes in sizes of the garments and waistbands being sewn. If automated operation is selected, the control system will automatically adjust the expansion of the waistband expansion assembly to its proper size.

Figure 10A:
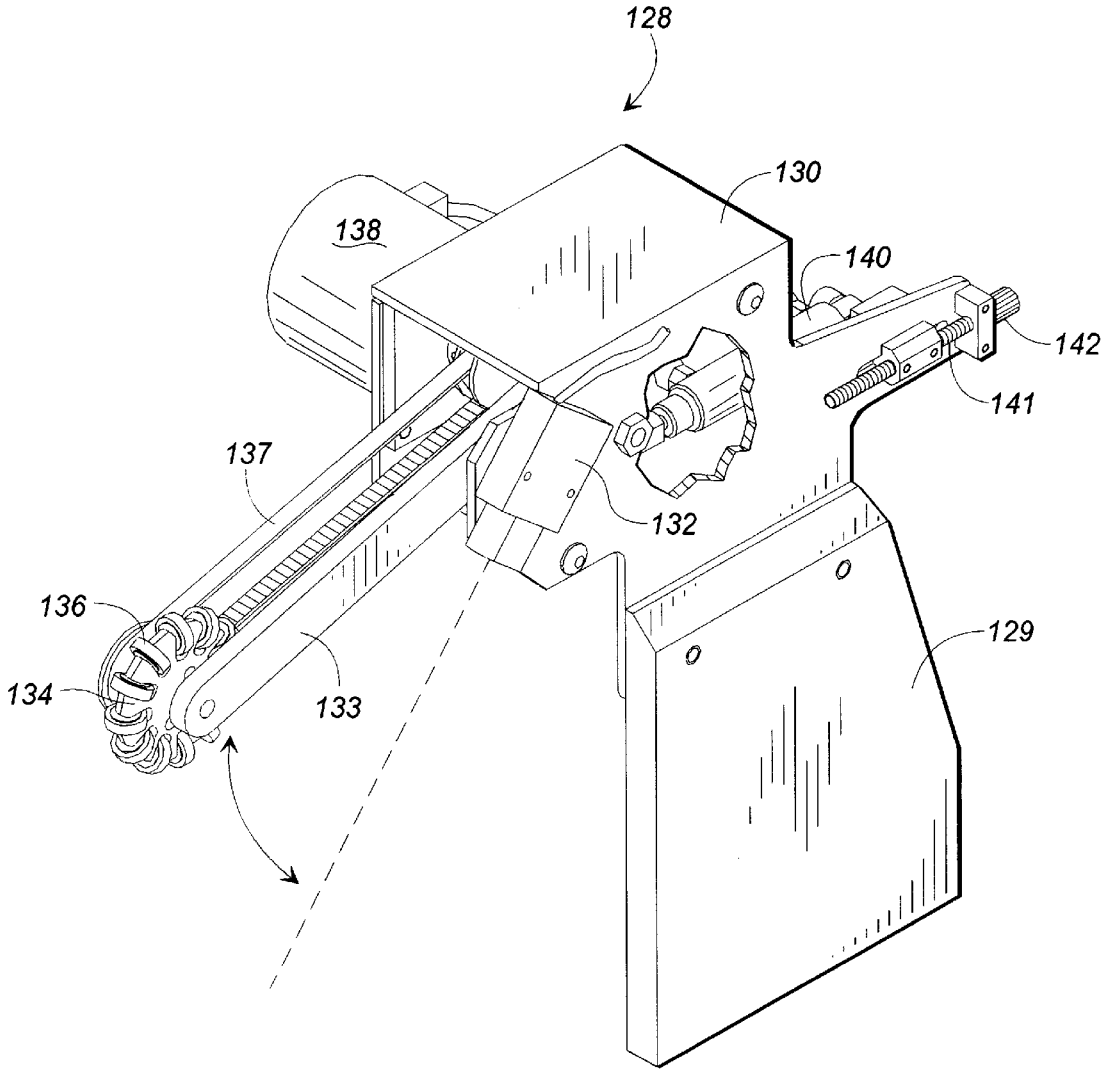
FIG. 10A is a perspective view of a top edge guide assembly used with the waistband attachment system of FIG. 1.

Referring to FIG. 10A, the top edge guide assembly has an elongate pivot arm 133 pivotally supported on housing 130, at an end of which a rotating guide roller 134 is positioned. Guide roller 134 is essentially a split wheel, having two opposed halves which rotatably sandwich a plurality of radially spaced free wheeling guide wheels 136 therein. Guide roller 134 is rotated about its axis by a drive belt 137, operated by a drive motor 138 supported on the housing 130. So constructed, the drive motor will rotate guide roller 134 such that it will rotate in a direction laterally across the sewing path for drawing the material across the sewing path while the radial spacing of the guide wheels 136 allows the guide wheels to rotate in the direction of the sewing path when the pivot arm is moved downward and engaged on the bottom ply of the folded waistband portion to allow the garment to be passed along the sewing path.

Figure 11:
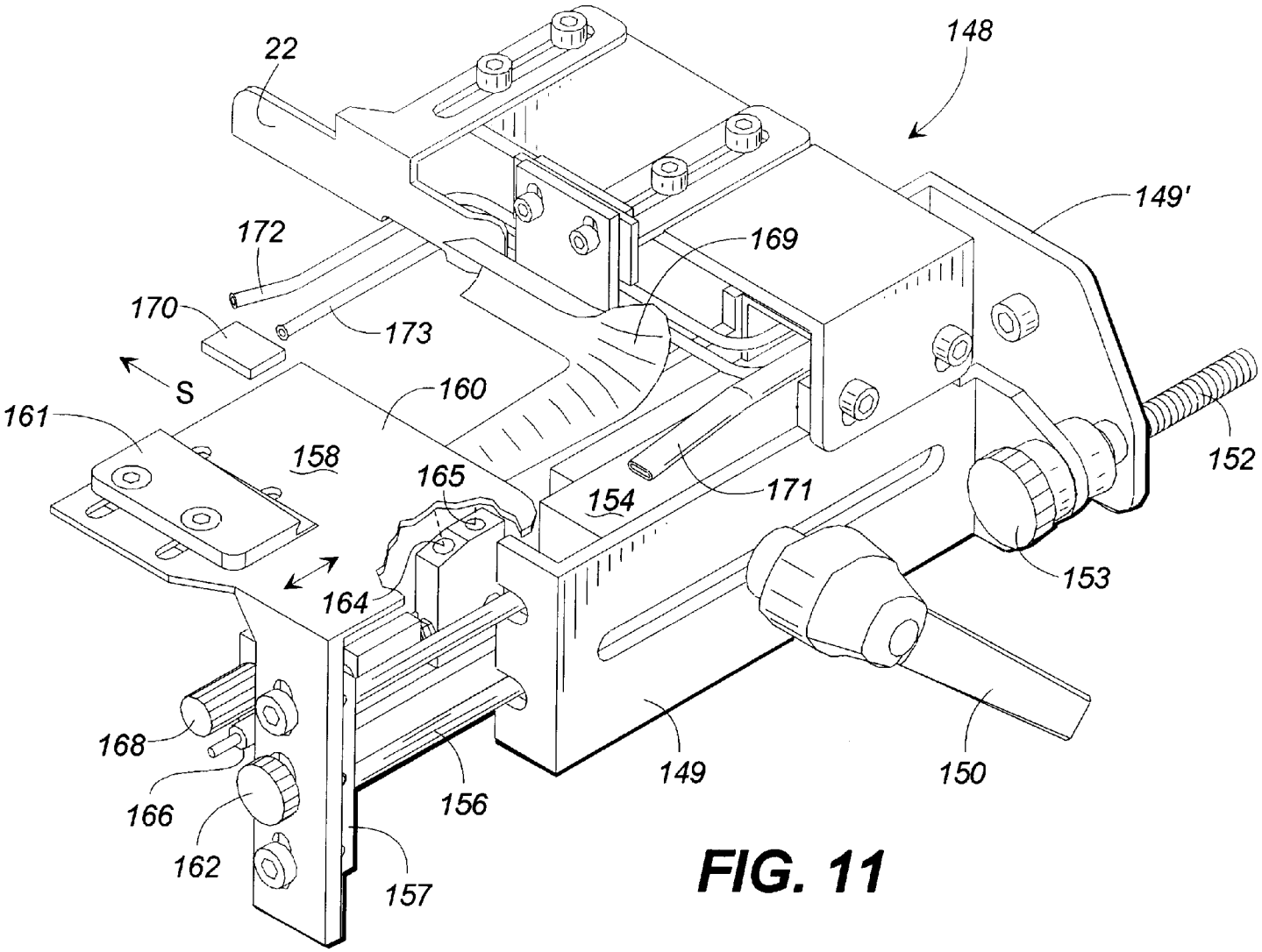
FIG. 11 is a perspective view of a folder assembly used with the waistband attachment system of FIG. 1.

As constructed, it is anticipated that guide roller 134 can be rotated in either direction across the sewing path, although it is preferred that the guide roller will be rotated in one direction only, namely in a clockwise direction so that it will tend to draw the bottom ply of the folded garment away from work table 14 (FIG. 1), thus drawing the waist edge along the folded top ply of the garment away from the knife of the sewing head assembly. It is anticipated that this will occur when the garment has been overfed beyond a desired degree by bottom edge guide assembly 64, as detected by a trim detection eye 164 (FIG. 11). The manner in which this takes place is described in greater detail below.

Pivot arm 133 is pivoted downwardly into engagement with the fabric of the garment just below the waistband portion of the garment along the sewing path by a pneumatic pivot cylinder 140. As with the pneumatic cylinder 178 (FIG. 14) that lifts and lowers garment support bar 176 (FIG. 1), pivot cylinder 140 is mechanically disadvantaged such that pivot arm 133 (FIG. 10A) is allowed to be urged upwardly by any pockets, hems, or seams encountered in the finished waistband as it passes thereunder and along the sewing path. It is anticipated that this mechanical disadvantage will occur by supplying pivot cylinder 140 with an air pressure of approximately 30 psi, although this will vary based upon the cross sectional area of the pivot cylinder, and the length of the pivot arm. What is desired is that pivot arm 133 will be physically engaged with the bottom ply of the folded hem just below the waistband portion, and will be engaged with sufficient force such that it can draw material across the sewing path and snugly about the elastic waistband, but not so tightly that the guide wheel is not allowed to "float" as the seam, or an eyelet in the waistband, for example, passes thereunder. Top edge guide assembly 128 is also provided with a position adjustment screw 141, controlled through a knob 142, for fine tuning the position of the assembly, and in particular the position at which guide roller 134 will engage the bottom ply of the folded garment along the sewing path.

Situated downstream of the folder wire assembly 102 and top edge guide assembly 128, upstream of sewing head assembly 16, is the folder assembly 148, as illustrated in FIGS. 1, 2, 10B and 11. Referring to FIG. 11, the folder assembly includes a carrier frame 149 supported on the system work table. The carrier frame can be moved laterally across the sewing path for positioning the folder assembly with respect thereto, and particularly with respect to the needles and the knife 170 of the sewing head assembly, and is locked into position by a locking screw 150 received within a locking slot defined in the carrier frame. When it is desired to move the carrier frame, locking screw 150 is released and position adjustment screw 152 is actuated through knob 153 for positioning the carrier frame, and in particular the folder tongue 158, as well as trim detector or sensor 164, and quality assurance detector or sensor 165, respectively, along the sewing path.

A position cylinder 154 is fastened to carrier frame base 149', and has a pair of cylinder rods 156 extending away therefrom and fastened to an extensible foot 157, such that the foot can be moved laterally across at least a portion of the sewing path. Fastened to the foot is a folder tongue 158 constructed in known fashion, to have an elongate folding edge 160 extending along the sewing path, with an elastic waistband guide 161 affixed thereto such that when the folding tongue is positioned extending into the fixed edge hem folding guide 169, the waistband guide acts as a fixed stop or guide against which the elastic waistband is held after it is placed about the attachment system. The elastic waistband guide 161 can be moved as needed to adjust for changes in the width of the elastic waistband.

Folder tongue 158 includes a position adjustment screw 162 which can be used to fine tune the position of the folder tongue along the sewing path. Positioned underneath the folder tongue is a first photosensor, a trim detector or sensor 164, which is aligned with the downstream knife 170 of the sewing head assembly during the pre-folding cycle and the beginning of the sewing cycle. The trim detector is used to locate and control the unfinished waist edge of the folded top ply of the garment, and controls the operation of top edge guide assembly 128 in association with control system 190 for removing material from the fold such that the position of the unfinished waist edge can be precisely controlled with respect to knife 170. Trim detector 164 is provided with a position cylinder 166 that moves the trim detection eye across the sewing path outwardly of work table and toward the position of the machine operator once the sewing operation of the attachment system has begun.

As described above, the bottom edge guide assembly 64 (FIG. 1) will overfeed the unfolded waist edge portion of the garment into folder wire assembly 102, and thus provide adequate material to form the fold about the elastic waistband, and provide enough material to align the unfinished waist edge with respect to the knife 170 (FIG. 1). This is detected by trim detector 164. Before the start of sewing operations, a "pre-sew" cycle occurs in which the unfinished waist edge of the garment is advanced along the sewing path and folded about the elastic waistband onto an opposed bottom side of the garment by being passed through bottom edge guide assembly 64 (FIG. 1), through folder wire assembly 102, underneath top edge guide assembly 128, and into folder assembly 148. The progress of the now folded pre-sew portion of the garment reaches the sewing head assembly 16. During the pre-sew folding of the garment, the unfinished waist edge extending along the now folded top ply of the garment is positioned in alignment with the knife of the sewing head, but is not yet fed into the knife. This is also the original position of the trim detector, in alignment with the knife.

Once operation of the attachment system is started for sewing the waistband into the garment, as described above, position cylinder 93 of bottom edge guide eye 92 begins to move the bottom edge guide eye inwardly toward work table 14 for overfeeding the unfinished waist edge of the garment into folder wire assembly 102, resulting in the presence of additional material that will extend beyond the sewn hem of the garment. Simultaneous with the inward movement of bottom edge guide detector 92 is the outward movement of trim detector 164 (FIG. 11), accomplished by position cylinder 166. Position cylinders 93 (FIG. 1) and 166 (FIG. 11) are operating in response to a software routine held within the control system 190 shown in FIG. 14, such that the trim detection eye begins to move into a position outwardly beyond the position of knife 170 (FIG. 11) along the sewing path.

The top edge guide assembly will take away or draw off only such amount of waistband material away from the knife to satisfy the requirements of the moving detector 164 such that the unfinished waist edge of the folded waistband is progressively introduced into knife 170 to prevent the formation of a tab at the beginning of the hem, along the seam of the waistband. It is desirable and designed into this system that the bottom edge guide assembly over-feeds the waist edge of the garment, so that trim detector 164 will signal the control system of the attachment system, which in turn will signal motor 138 (FIG. 10) of the top edge guide assembly to rotate guide roller 134 for drawing material in the waistband portion of the garment across the sewing path, which will have the effect of drawing the waist edge away from the knife until the waist edge is in alignment with the trim detector as it continues to move outwardly toward the machine operator, for progressively moving the waist edge into the knife. As the trim detector reaches its outward most position, it will signal the control system, which in turn will signal the top edge guide assembly to draw material across the sewing path to provide for fine adjustment of the alignment of the edges of the garment and waistband to ensure that the waist edge is aligned with the trim detector and that an adequate amount of trim material is being fed into the knife. The trim detector will move across the sewing path a distance of approximately ⅜" or so, as desired. The overfeeding and pulling back of the waist edge during guiding produces a tight wrap of the garment material around the elastic, which is a desirable feature and considered an indicator of a high quality garment.

As known to those of skill in the art, a trim of more than ⅜" is generally not desired as the knife has only a ½" trim capacity and greater amounts will tend to cause curl or tab formation in the waistband, and also results in the undue waste of garment material. A trim of approximately ⅜" should allow for the elastic waistband to be completely hemmed into the waistband, and allow a neat, trim, and quality waistband to be sewn into the garment. Once the waistband is sewn into the garment, the trim detector and the bottom edge guide detector will return to their original positions for the start of the next machine operation cycle. As shown in FIG. 11, trim detector 164 is provided with a fine position adjustment screw 168 for fine tuning the position of the trim detector along the sewing path, and more particularly with respect to knife 170 for setting the amount of material to be trimmed off from the waist edge of the garment. This fine adjustment enables the system to be set so as to align button holes formed in a garment for adding draw strings during processing of garments with such construction.

The folder assembly 148 further includes a fixed edge hem folding guide 169 into which the folder tongue 158 is reciprocably moved by position cylinder 154. In so doing, folding edge 160 of the tongue will provide an edge to wrap around and maintain the folded edge portion of the garment in the folding guide 169, and will thus complete the folding of the waistband prior to the passage of the folded top and bottom plies of the garment into the sewing head of the system. Prior to the passage of the folded hem beneath the sewing head, for forming the hem therein, the unfinished waist edge of the garment is directed into the knife 170 for being trimmed, as described above, and by the combination of blowers provided as a part of the folder assembly.

As shown in FIG. 11, an uncurl blower 171 is provided at an upstream edge of the folder tongue, and acts to blow just above the folder wire and underneath the folder tongue and the folded top ply of the garment, for removing any curl from the top ply just before it is advanced onto the sewing head. Situated slightly downstream of uncurl blower 171 is a blower 172 which will direct a stream of pressurized air under the garment and across the top ply thereof to remove any curls or wrinkles as the garment waist edge leaves the knife and approaches the needles, which could otherwise be sewn into the hem. Situated upstream of blower 172 is a third blower 173, which also blows underneath the garment and across the folded top ply of the garment at the knife 170 to thus ensure that at the completion of the hem, along the hem seam of the waistband, any tab which may tend to be gathered or otherwise formed is blown into the knife and trimmed rather than being sewn into the garment.

Figure 10B:
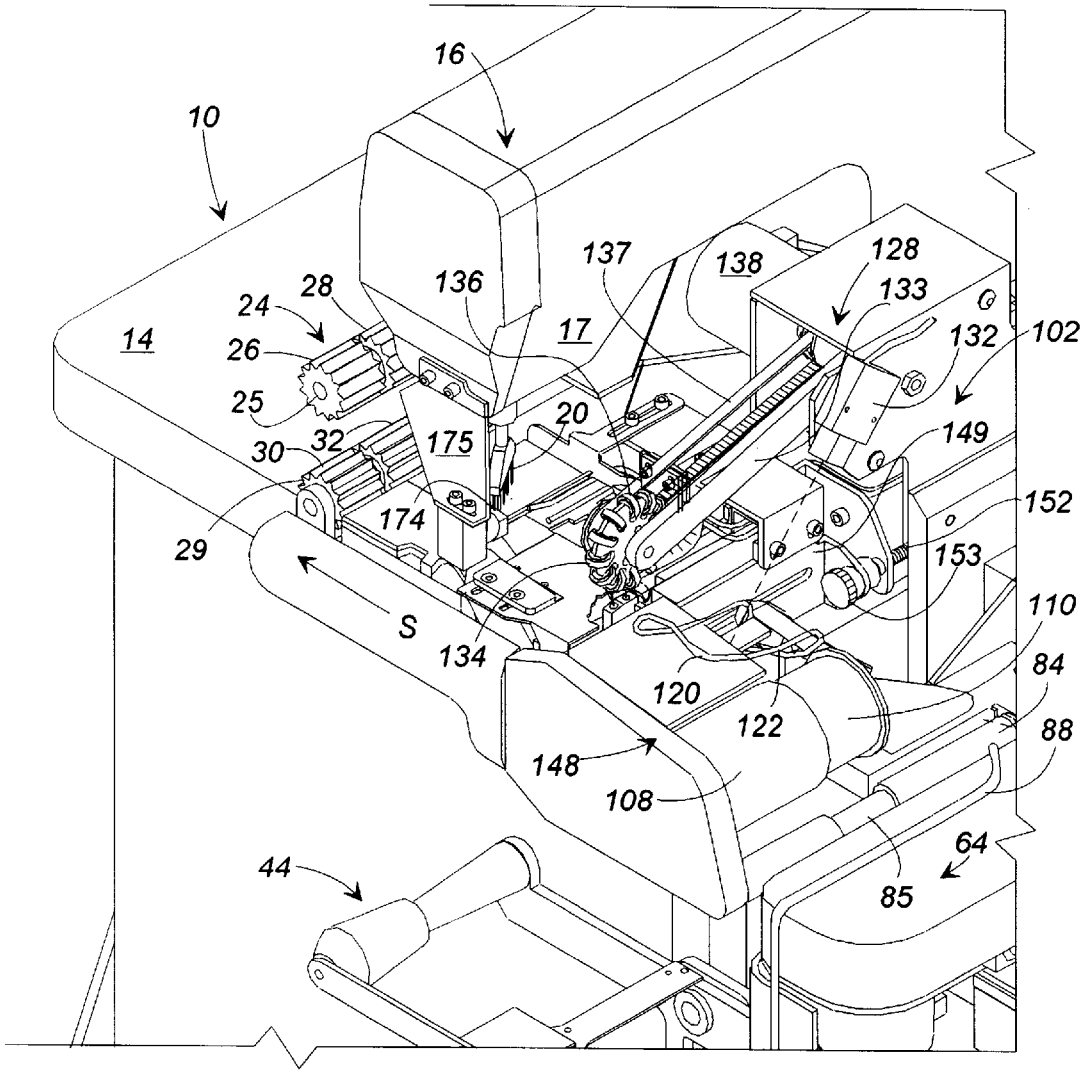
FIG. 10B is a perspective view of the top edge guide assembly and folder assembly of the waistband attachment system of FIG. 1.

As illustrated in FIG. 10B, a side seam detector 174 is positioned upstream of the sewing needles 18 of the sewing head 17 along the sewing path S. The side seam detector 174 typically is a photoelectric eye or similar sensor and is mounted to and supported by a side seam detector mounting bracket 174' attached to the sewing head and extending outwardly and downwardly therefrom. The side seam detector looks for a side seam in the garment during the prefold cycle of the waistband attachment system to signal the controller that the side seam has been detected. The controller uses the operator preset time to position the side-seam at a desired location and determines when to begin sewing. Precise location of the side seam in relation to the stitch overlap area is desirable and is an indication of superior quality of the garment in the apparel industry. If the side seam in the garment is not detected within a preset time frame, the control system for the waistband attachment system will indicate an error or fault condition which causes the machine to stop operation to allow the garment to be removed and repositioned prior to being sewn to avoid the formation of a defective garment. This feature can be disabled when sewing garments without a side seam.

As shown in FIG. 1, the attachment system also includes a garment support bar 175 constructed and arranged for movement from a first stored position on the framework into a second, extended position (not illustrated) for supporting at least the legs of a garment thereon so that the weight of the garment is not fully carried by the waistband expansion assembly 44, bottom edge guide assembly 64, folder wire assembly 102, top edge guide assembly 128 and folder assembly 148, which would have the effect of tending to pull the garment off of the attachment system resulting in a less than adequate hem being sewn into the waistband portion of the garment. The garment support bar 175 is carried on a pivot arm 175' which itself is actuated by a pneumatic cylinder 176 (illustrated schematically in FIG. 15), at a mechanical disadvantaged ratio such that the garment support bar cannot strike a person with sufficient force so as to cause injury or damage to such person or their clothing should they interfere with the movement of the garment support bar. It is intended that the garment support bar will be supported with enough mechanical leverage to adequately carry the weight of the garment thereon, but will not be so rigidly or so quickly extended as to be unyielding when moved against a person or foreign object.

Figure 12:
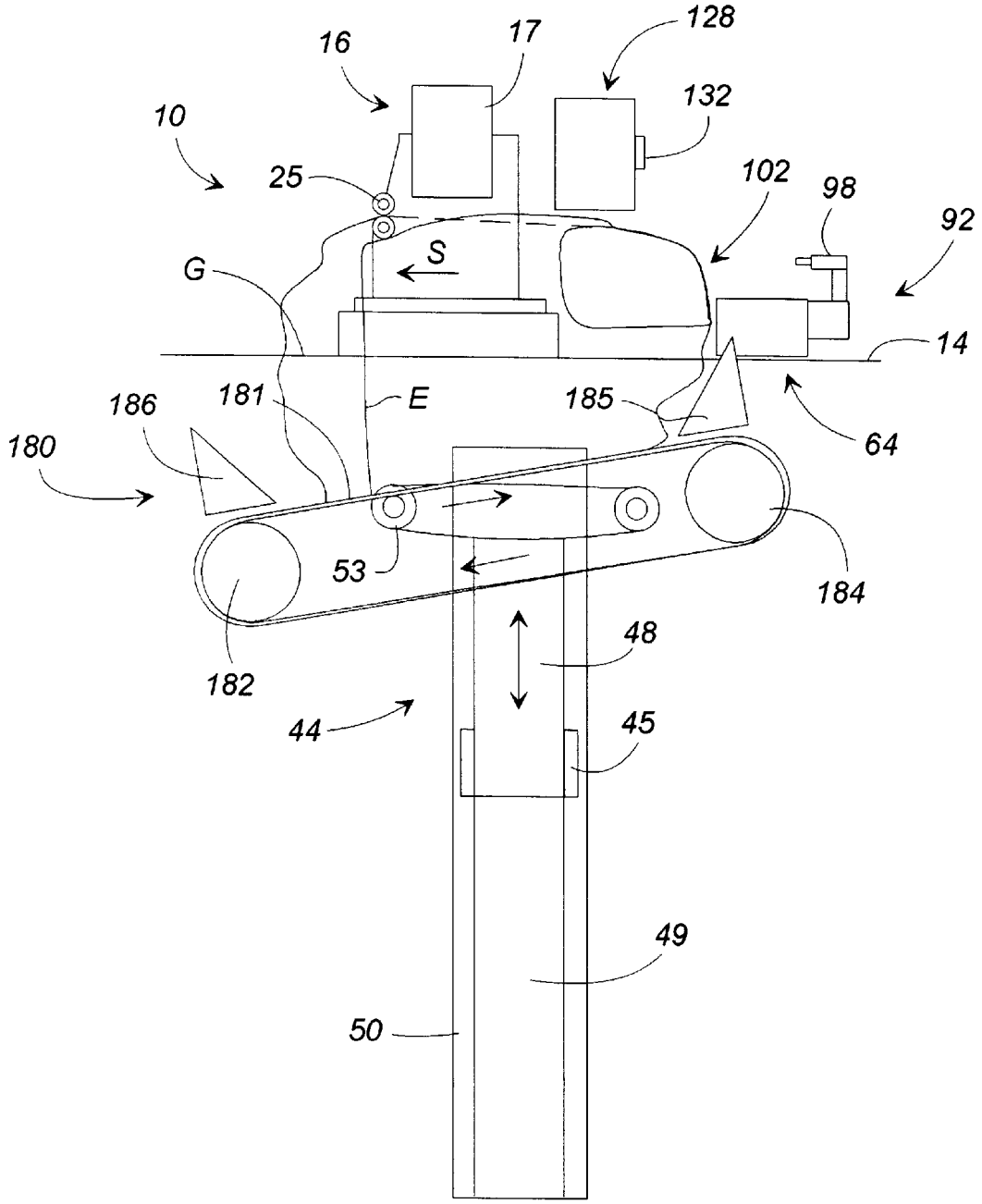
FIG. 12 is a schematic illustration of a garment tumbler device used with the waistband attachment system of FIG. 1.

FIGS. 12 schematically illustrates the attachment system in use with a garment tumbling device 180 which may be used in lieu of the garment support bar 175 of FIG. 1. The garment tumbling device includes an inclined continuous belt 181 extending along a return portion of the sewing path and moving in the return direction of the sewing path along its top run on which a garment may be supported. Belt 181 is driven by a drive roll 182, and has a downstream idler, or driven roll 184. A drive motor 183, schematically illustrated in FIG. 15, powers drive roll 182 (FIG. 12). A pair of opposed end ramps or guides 185, 186 are positioned at each respective end of the top run of belt 181, and act to guide the legs, or body, of the garment such that it tends to stay in position on the garment tumbling device during use.

Once the elastic waistband is passed about the puller roller assembly, the waistband expansion assembly, the bottom edge guide assembly, the folder wire assembly, the folder assembly, and through the sewing head assembly, the unfinished waist edge portion of the garment is then folded about the waistband in an overlying relationship. Thereafter, the bottom edge guide assembly 64 (FIG. 6B) will be moved into engagement such that guide wheels 82 become engaged with idler roller 84 for pinching the garment therebetween, whereupon the garment tumbling device will be moved upwardly into an engaging position. As this occurs, it is anticipated that the operator will either manually place the legs or body of the garment, or the legs will automatically fall, upon belt 181 of the garment tumbling device. As known to those of skill in the art, as the waistband is sewn into the garment, the garment tends to tumble and become twisted as it advances along the sewing path. The belt 181 of the garment tumbling device thus is moved in timed relationship with, and at the same linear speed, as the elastic waistband and thus the waist portion of the garment, along the sewing path. End ramps 185 and 186 tend to keep the garment confined within the garment tumbling device such that it will be gently rotated or tumbled by the belt and the guides so that the legs, or body of the garment are kept from twisting and tending to pull the garment off of the machine.

It is anticipated that the garment tumbling device may be pivotally supported on the framework of the attachment system such that it moves from a first stored position close to the framework into an extended article carrying/tumbling position after the elastic waistband and the waistband portion of the garment are placed on the attachment system. It is anticipated that the garment tumbling device 180 will also be mechanically disadvantaged such that it will not injure the body of any operator placing garments on the attachment system, or working in close proximity thereto during machine operation as it moves into its article carrying position.

Figure 13:
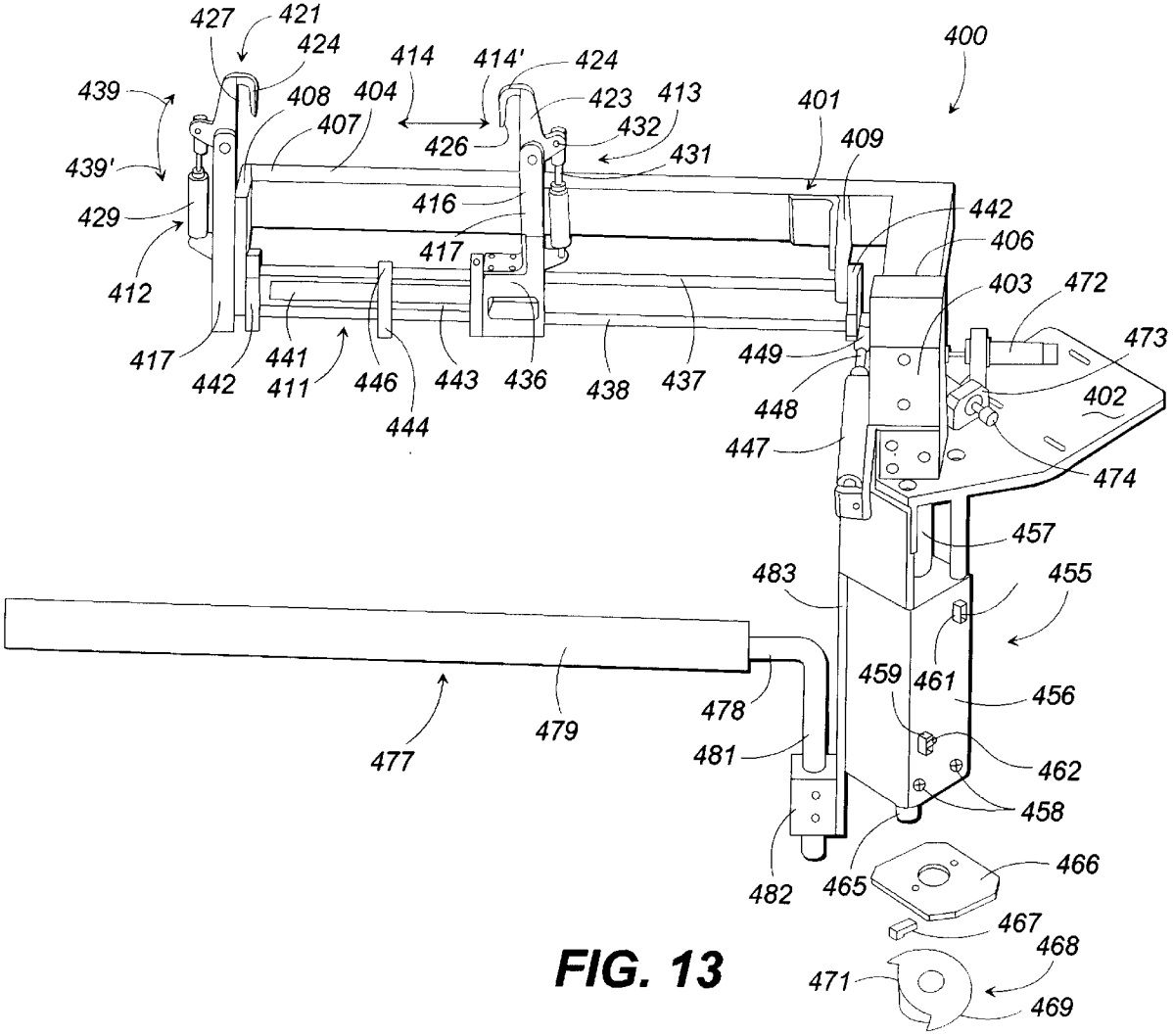
FIG. 13 is a side elevational view of the stacking assembly.

It is further anticipated that the waistband attachment system will be provided with a garment stacking assembly 400 as shown in FIGS. 1, 2, and 13. The stacking assembly 400 generally includes a main pivot arm 401 that is mounted to the work table 14 (FIGS. 1 and 2) of the attachment system by a mounting plate 402 that typically is formed from a metal such as steel or other high strength material. The main pivot arm is attached through the mounting plate 402 so as to be movable in a substantially arcuate movement over approximately a 150° to 180° arc between an at rest, disengaging or stacking position, displaced from the sewing area of the attachment system as indicated in FIG. 1, and an engaging or gripping position adjacent the sewing area of the system (not illustrated). The main pivot arm is substantially L-shaped bar generally formed from steel, aluminum or a similar durable high strength material, and includes a base portion 403 that extends vertically and which supports a horizontally extending, substantially L-shaped arm or bar 404 that is approximately 24 to 28 inches in length.

As illustrated in FIG. 13, the arm 404 has a proximal end 406 adjacent the base 403 and a distal end 407 spaced therefrom. Mounting brackets 408 and 409 are attached along the length of the arm portion 404 with mounting bracket 408 being attached at the distal end 407 of the arm and mounting bracket 409 being mounted at an intermediate position spaced along the length of the arm. The mounting brackets 408 and 409 generally are formed from the same metal as the main pivot arm and pivotably support a gripper assembly 411 along the length of the arm 404. The gripper assembly 411 includes a pair of pivoting gripper arms 412 and 413, with gripper arm 412 being mounted along the outside edges of the mounting bracket 408 in a fixed position at the distal end of the arm 404, and gripper arm 413 being movable along the length of the arm in the direction of arrows 414 and 414'.

Figure 14A:
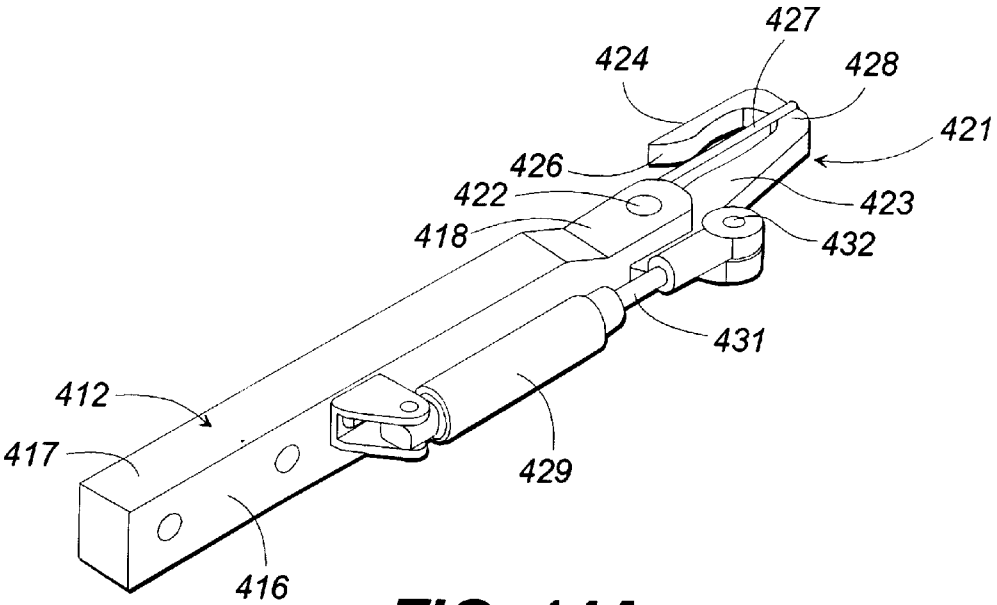
FIG. 14A is a perspective view of one of the grippers of the stacking assembly in its open position.
Figure 14B:
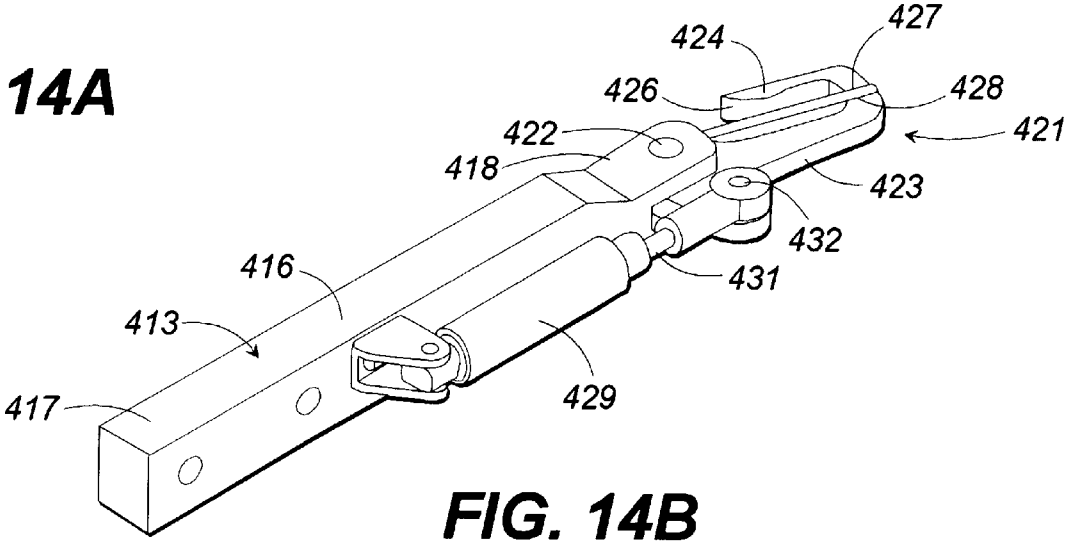
FIG. 14B is a perspective view of one of the grippers of the stacking assembly in its closed position.

The gripper arms are illustrated in greater detail in FIGS. 14A and 14B and generally include a substantially rectangular shaped arm or base 416 typically made out of aluminum or similar metal material or a plastic, if so desired, having a lower end 417 and an upper end 418 typically formed as a yoke or collar. A substantially U-shaped gripper or hook 421 is pivotably attached to the upper end 418 as by a screw or pivot pin 422. Each of the grippers typically is formed from a metal such as aluminum and has a base portion 423 that is received within the upper end 418 of its gripper arm 416 and through which the pivot pin 422 is extended and further includes a finger or bill 424 portion spaced outwardly from the base and having a sloped or beveled front edge 426 to facilitate the grippers engaging or picking up a garment from the sewing area of the attachment system.

A clip 427 is fixedly attached to the upper end 418 of each gripper arm 416, with each clip being generally formed from a metal such as a spring steel and yieldably biased against the finger or bill of its gripper when the gripper is in its closed position (FIG. 14B) for holding a portion of the garment therebetween. Each clip further has a notch or cut-out portion 428 through which the finger or bill of the gripper extends. As a result, the clip surrounds the top of the gripper finger or bill to avoid the garment becoming pinched between the clip and bill or finger of the gripper and being trapped so that the gripper will not release the garment for stacking. An air cylinder 429 is mounted to each gripper arm and gripper 421 for pivoting the grippers between their open and closed positions shown in FIGS. 14A and 14B, respectively. Each cylinder is typically a half inch stroke 9/16" bore pneumatic cylinder, such as is manufactured by BIMBA and is supplied with 60 to 80 psi of compressed air, and includes a cylinder rod 431 that connects to the base 423 of each gripper 421 via a connector 432.

As illustrated in FIGS. 1 and 13, gripper arm 412 is fixedly mounted to the distal end 407 of the arm 404. Gripper arm 413 is mounted on a slide block 436 so as to be movable in the direction of arrows 414 and 414' toward and away from the gripper arm 412. The slide block 436 generally is formed from a material such as aluminum or plastic or similar light-weight, durable material and slides along a pair of travel rods 437 and 438 that extend along the length of the arm 404, spaced beneath the arm as illustrated in FIG. 413. The upper most travel rod 437 extends through each mounting bracket 408 and 409 so as to pivotably support the gripper assembly on the mounting brackets while enabling the gripper assembly to be pivoted in the direction of arrows 439 and 439' between a raised, vertically extending nonengaging or holding position and a lowered, horizontally extending engaging or gripping position. The slide block 436 and thus gripper arm 413 us moved along the travel rods 437 and 438 to adjust the position of gripper arm 413 with respect to gripper arm 412 to accommodate different sizes of garments being sewn and stacked.

A travel cylinder 441 is mounted between the travel rods adjacent a connector bracket 442 for the travel rods mounted at the end closest to gripper arm 412. The travel cylinder 441 typically is a pneumatic or hydraulic cylinder, generally having a ¾" bore with a 4" stroke, such as is made by BIMBA, and includes a cylinder rod 443 connected to the slide block 436 of gripper arm 413. The travel cylinder is mounted to an adjustable stop 444 through which the travel rods are extended and which thus is movable along the length of the travel rods for adjusting the position of the travel cylinder and thus the gripper arm 413 along the travel rods. The stop generally is fixed in place through a set screw indicated at 446. The travel cylinder further is connected to the control system 190 of the waistband attachment system so that it is energized with approximately 60 to 80 psi of compressed air to move the gripper arm 413 as needed.

A pivot cylinder 447 is mounted adjacent the proximal end 406 and base 403 of the arm 404, connected to the two connector brackets 442' for the travel rods 437 and 438. The pivot cylinder typically is a pneumatic air cylinder, such as is made by BIMBA, having approximately a ¾" bore with approximately a 2" stroke and is pressurized between 60 to 80 psi. The pivot cylinder includes a cylinder rod 448 attached to the connector bracket 442' adjacent the proximal end 406 of arm 404 via a pivoting connector 449. The operation of the pivot cylinder 447 is controlled by the computer control for the waistband attachment system and causes the gripper assembly 411 to be pivoted in the direction of arrows 439 and 439' for engaging and removing a garment from the sewing area of the attachment system.

As illustrated in FIGS. 1, 2, and 13, a rotary actuator 455 is mounted to the underside of the mounting plate 402, connected to the main pivot arm 401 at the base 403 of the main pivot arm. The rotary actuator typically is a pneumatic rotary actuator such as a model S-350-180-04 TURN-ACT actuator having the capacity to rotate t lease 180°, with its rotational movement being adjustable as needed, although it will be understood by those skilled in the art that hydraulic actuators and similar devices such as electric motors also can be used. The rotary actuator includes a body 456 and a drive shaft 457. The drive shaft 457 is connected to the base 403 of the main pivot arm 401 via a coupling (not shown) that generally includes opposed plates each having a series of roller bearings and with the connector being preloaded at the point where the shaft goes through the bearing plates to insure stability and smooth operation. Set screws 458 extend through the lower portion of the body 456 of the rotary actuator and function as adjustable stops for adjusting the rotational movement of the drive shaft of the rotary actuator to thus adjust the arcuate rotational movement of the main pivot arm.

The rotary actuator further generally is a four valve vane-type actuator having a series of air fittings 459 and 461 being mounted to its body and connected to an air supply via supply lines 462. The air fittings are spaced so as to proximally be on opposite sides of the vanes (not shown) of the rotary actuator. When actuated, a supply of air at approximately 60 to 80 psi is applied on opposite sides of the vanes through the air fittings 459 and 461 so as to equalize the pressure in the rotary actuator at start up. As a result, when air is applied to the system or the system is engaged at a start up, the main pivot arm will generally remain in its set position instead of swinging or shifting rapidly as pressure is applied to the actuator, so as to avoid and substantially minimize any risk or danger of injury to the operator due to the pivot arms being forced to swing rapidly into the operator as air is applied thereto. During a stacking operation, air is supplied on one side of the vanes as it is drawn from the other side of each vane to move the pivot arm about its arcuate motion. This provides the main pivot arm with three states, moving toward the sewing head, moving away from the sewing head and an idle position.

As shown in FIG. 13, the lower end 465 of the drive shaft 457 extends through the bottom of the body 456 of the rotary actuator 455. A mounting plate 466 is received thereover and attaches to the bottom of the body of the rotary actuator and supports a position sensor 467. The position sensor generally is a proximity type sensor, photocell or similar sensor. A timing vane 468 is mounted to the lower end 465 of the drive shaft and includes a substantially circular rim portion 469 with a cut out portion 471 formed therein. The cut out is formed along an arc of approximately 150° to 180° such that at times the proximity switch will be covered and at other times uncovered as the main pivot arm is rotated between its disengaging and engaging positions. As the main pivot arm starts to rotate, towards its engaging position, the position sensor is uncovered so as to alert the control system that the pivot arm is moving and start the downward pivoting motion of movement of the gripper assembly 411 in the direction of arrow 439. Likewise, on the return cycle of the main pivot arm, the gripper assembly begins to lift in the direction of arrow 439 when the cut out portion again passes the position sensor so as to avoid the garment being caught or engaging the elements of the waistband attachment system as it is removed from the sewing area and lifted to a stacking position. In addition, if the proximity sensor does not detect the cut out, i.e., it is not uncovered, within a certain time frame an error signal is generated in the control system indicating a fault condition. In response, air is sent to both sides of the rotary actuator to halt further movement of the main pivot arm and put the main pivot arm in its idle position. At the same time, an error indication is displayed for the operator. The size of the cut out or window 471 further can be adjusted to increase or decrease the dwell or timing of the rotation or pivoting motion of the gripper assembly.

In addition, as indicated in FIGS. 1, 2, and 13, adjustable stops or shock absorbers 472 and 473 are mounted to the mounting plate 402 adjacent the base 403 of the main pivot arm 401. The stops generally include an adjustable cushion or pad 474 against which the base of the main pivot arm will come to rest as the main pivot arm is pivoted between its disengaging and engaging positions. The stops cushion the main pivot arm to control the stopping of the main pivot arm and prevent it from snapping or stopping too abruptly and possibly dislodging the garment.

A stacker bar 477 is mounted below the main pivot arm when the main pivot arm is in its disengaging or rest position, as indicated in FIG. 1. The stacker bar generally is an elongated substantially L-shaped bar or beam having a horizontally extending portions 478 over which is applied a pad or nonslip surface 479, such as a neoprene pad, to prevent the fabric of the garment being stacked thereon from shifting or moving, and a vertically extending portion 481. The vertically extending portion 481 is received within a mounting bracket 482 that is attached to an angle bracket 483 attached to the rotary actuator. This mounting of the stacker bar in bracket 482 enables the position of the stacker bar to be adjusted both vertically and rotationally so the operator can adjust the position of the stacker bar as desired to best fit her range of movement when operating the attachment system. The operator further can adjust the position of the stacker bar to enable the size of the bundles of garments being stacked thereon to be varied and for better performance of the stacker bar to fit the certain types or sizes of garments being stacked thereon.

In addition, it is also possible to use an air cylinder or motor (not shown) mounted to the vertically extending portion 481 of the stacker bar for vertically adjusting the position of the horizontal portion of the stacker bar as needed. A sensor (not shown) provided for reading the height of a stacked bundle of garments on the stacker bar and as the sensor is tripped, indicating that a certain height stack or bundle of garments has been reached, the control system actuates the cylinder to adjust the vertical position of the stacker bar incrementally at programmed levels as needed to increase stacked bundle sizes while leaving the top garments on the stack within easy reach and for easy inspection, and to further insure proper stacking of the garments when larger bundles of garments are desired.

Figure 15:
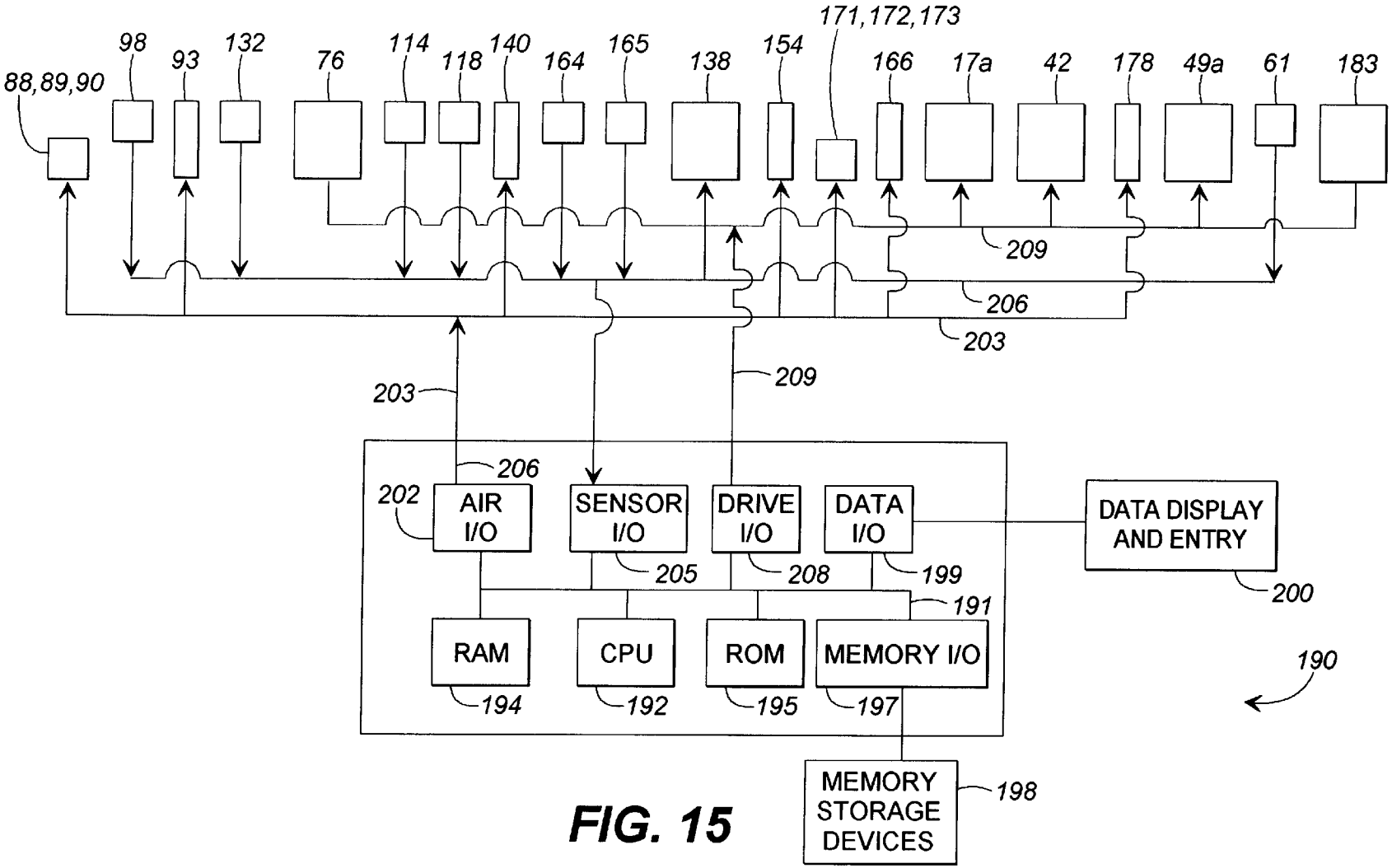
FIG. 15 is a schematic illustration of the control system of the waistband attachment system.

The control system, or machine controller, which controls the automated operation of attachment system 10 is shown schematically in FIG. 15. The control system 190 includes a computer 190*a* having a data bus 191 in communication with the several components of the computer. These components include a central processing unit or CPU 192, a random access memory ("RAM") 194, and a read only memory ("ROM") 195. ROM 195, in known fashion, may comprise a hard disc drive, for example, or an EPROM into which the control program(s) used to operate the attachment system 10 are "burned". The computer also includes a memory I/O card 197 in communication with one of a variety of external memory storage devices, illustrated schematically in FIG. 15. These external memory storage devices may include, for example, a floppy disc drive, a CD ROM drive, a DVD drive, a magnetic tape drive, or other known types of portable memory storage devices.

Computer 198 has a series of input/output cards in communication with data bus 191, to include a pneumatic control input/output card 202, having a signal path 203 to the several pneumatic or air-powered components of the machine. The computer will also include a detection eye, or sensor, input/output card 205, having a signal path 206 in communication with the several sensors used in the system, all of which are described above, and a drive input/output card 208 having a signal path 209 in communication with the several drive motors used in the attachment system 10. Lastly, a data input/output card 199 in two-way communication with an external data display and entry device 200 is provided. Data display and entry device 200 is preferably a touch-sensitive display screen used for both displaying the system operating parameters, as well as selecting the system operating parameters.

CPU 192 will preferably be a microprocessor, for example a Z8 microprocessor manufactured by Zilog and programmed in Z8 assembly language. It is understood, however, that similar microprocessor or computer chips capable of such control operations can be used in place of a Zilog Z8 microprocessor. Additionally, in lieu of a combined data display and entry device 200, if so desired, a separate data display, and data entry device, for example a keyboard, can be provided.

Input/output card 202 is in communication with a solenoid valve (not illustrated), or solenoid valves (not illustrated), which will actuate blowers 88, 89, and 90 at the bottom edge guide assembly, and blowers 171, 172, and 173 at the folder assembly. Additionally, this input/output card will also be in communication with the respective solenoid valves (not illustrated) that will actuate position cylinder 93 used to control the movement of the bottom edge guide detector 92; pivot cylinder 140 of top edge guide assembly 128; pivot arm 133 of top edge guide assembly 128; position cylinder 154 used to reciprocate folder tongue 158; position cylinder 166 used to move trim detector 164 across the sewing path; and the movement of drive cylinder 178 used to raise and lower garment support bar 176, if provided as a part of the attachment system. Input/output card 205 is adapted to receive the signals emitted by each of the respective detectors or sensors, such as photoelectric eyes, used in the operation of the machine, to include bottom edge guide detector 98, seam detection switch 118, elastic detection detector 132, proximity sensor 114, trim detector 164, quality assurance eye detector, and receiver 61 of the waistband expansion assembly. The drive input/output card 208 will control the operation of drive motor 76 of the bottom edge guide assembly; drive motor 138 of the top edge guide assembly; drive motor 17*a* provided as a part of the sewing head assembly; drive motor 42 used to rotate puller roller 25 of the puller roller assembly; and waistband expansion assembly drive 49*a* used for moving the drive belt 49 (FIGS. 1–3) of the waistband expansion assembly for moving carrier 52 toward and away from the sewing head. If garment tumbler device 180 is provided in lieu of garment support bar 175, then the drive input/output card 208 will also control the operation of a drive motor 183 used to rotate drive roll 182, for powering continuous belt 181 of the device.

It is anticipated that the several detection eyes, or sensors, described hereinabove will preferably be photosensors, with the exception of proximity sensor 114, which may instead be a magnetic sensor for sensing the passage of the timing marks formed on timing disc 112. Other conventional sensors or eyes may be substituted for those described above. The respective drive motors, 76, 138, 17*a*, 42, 49*a*, and 183 (if provided) may comprise stepper motors as well as any conventional AC or DC motors. For more precise control of the system drives, it is possible that servo motors, using position feedback devices, for example encoders, resolvers, or linear transducers, may be used to more positively and accurately control the system. However, as known to those of skill in the art, servo motors will tend to increase the cost of the machine whereas stepper motors are a more affordable and practical alternative that will attain the necessary results in the operation of attachment system 10.

Figure 16A:
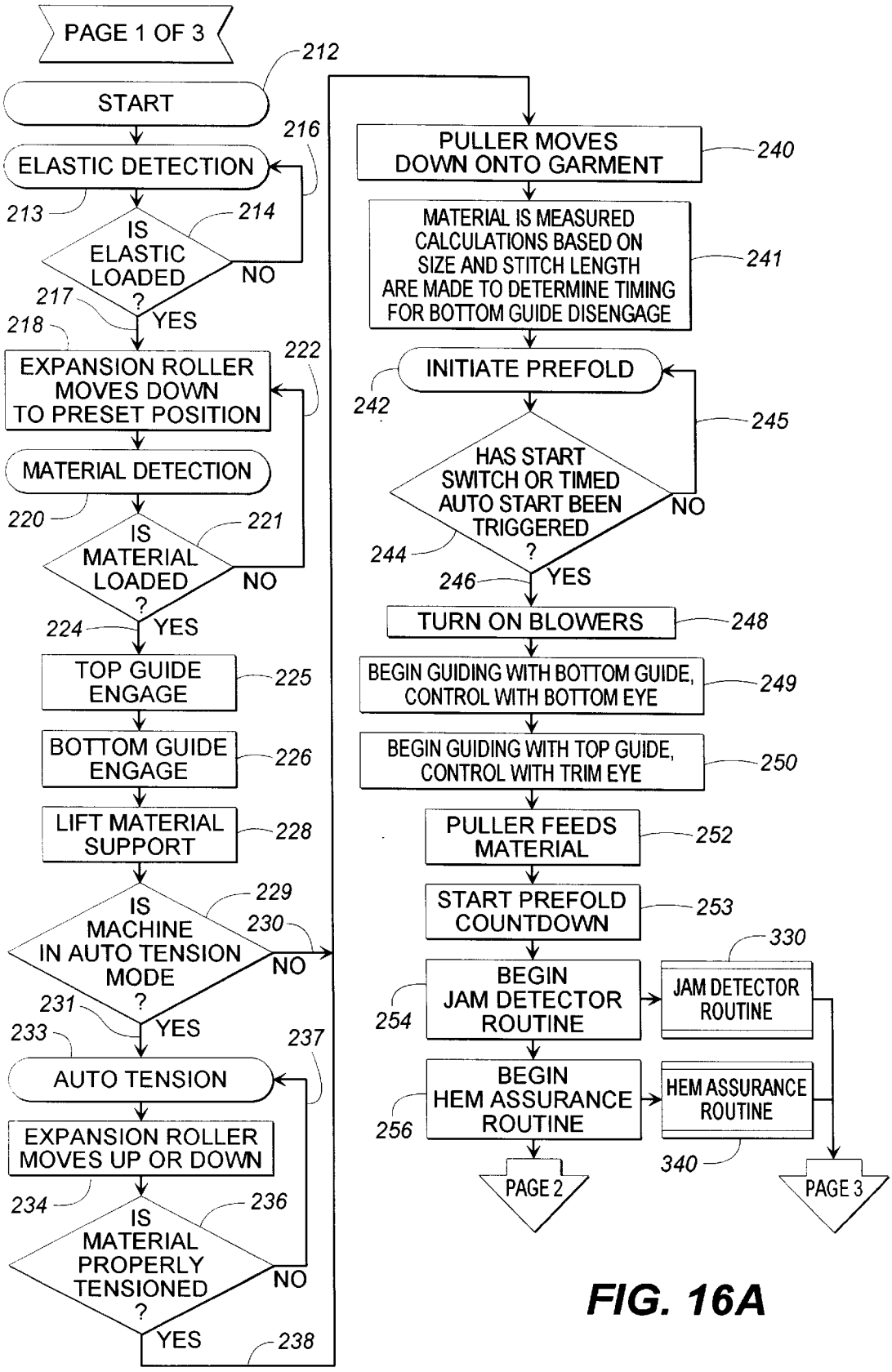
FIGS. 16A–16C illustrate a flow chart of a machine control routine used to operate the waistband attachment system.
Figure 16B:
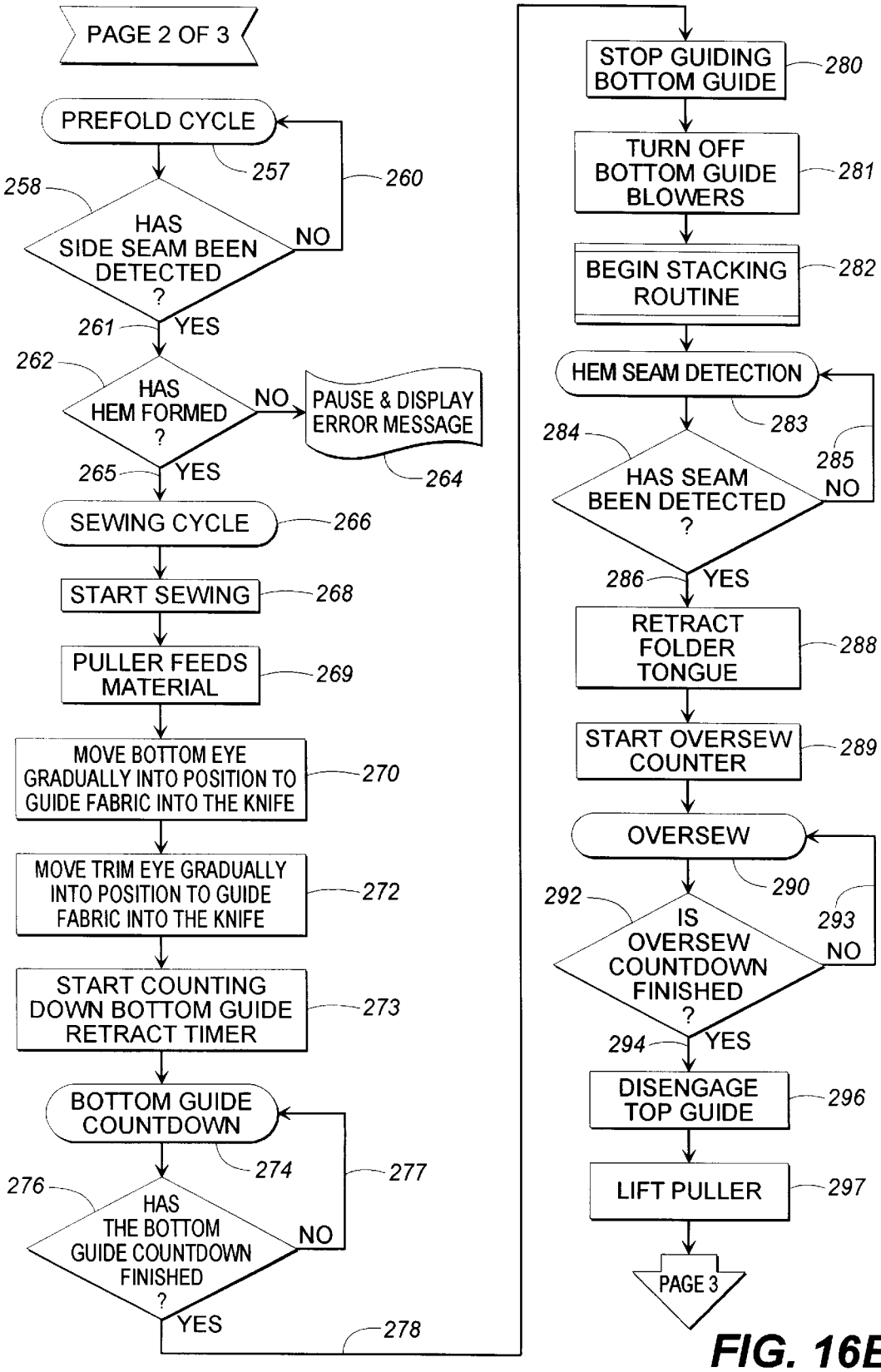
Figure 16C:
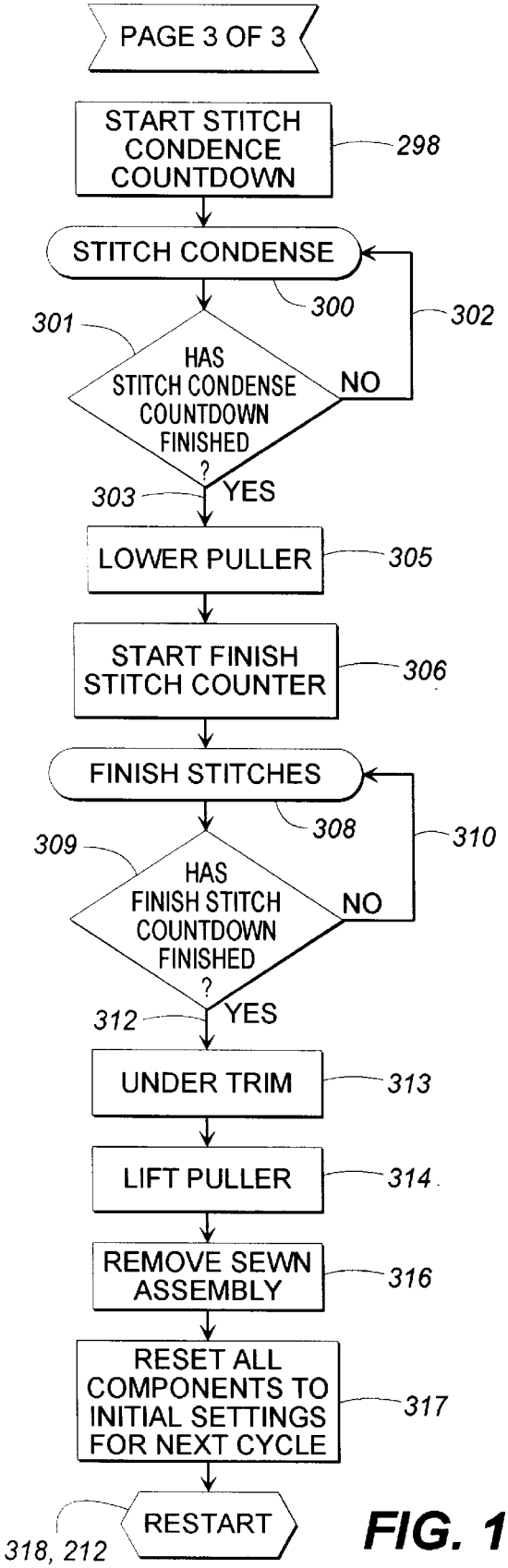

The control routine executed by control system 190 is illustrated in FIGS. 16A–16C, which are a flow chart of the steps followed by the control routine. It is understood by those skilled in the art that each step illustrated in FIGS. 16A–16C, as well as in the subroutines of FIGS. 17A, 17B, 18A, 18B and 18C, represent a block diagram of executable program code. It is anticipated that the control routine of FIGS. 16A–C, and the subroutines of FIGS. 17A and B and 18A will be stored within ROM 195 of the computer.

Referring now to FIG. 16A, the first step of machine operation is represented by block, or step, 212, representing the system's state upon power up. The next sequential step followed by the program is step 213 of determining whether the elastic waistband has been detected on the attachment system, which occurs at step 214, in response to a query made to the elastic detection eye 132 (FIGS. 1, 3) as to whether an elastic waistband is present on the machine. If not, the program loops back on itself in step 216 to the elastic detection step. If, however, the elastic waistband is detected in step 217, the program then moves to step 218, whereupon the waistband expansion assembly moves down to a predetermined position which will expand the waistband to a predetermined size.

In steps 220 and 221 the control program polls the machine, more particularly the sensors provided as part of the machine, to detect whether the garment has been loaded onto the waistband attachment system in overlying relationship with the elastic waistband. Thus, in step 221, if material is found not to be loaded, the program loops back on itself in step 222 to step 220, and continues to loop until such time as it detects that the garment is loaded on the machine in step 224, whereupon it advances to step 225 at which point the top edge guide assembly is engaged by moving pivot arm 133 (FIG. 10) downwardly with pivot cylinder 140, until such time as the guide roller 134 is engaged on the waistband portion of the garment. In step 226 the bottom edge guide assembly is engaged on the garment by pinching the garment between guide wheels 82 (FIG. 6B) and idler roller 84. This is accomplished by moving the bottom edge guide assembly toward and into engagement with the bottom edge guide idler roller with a pneumatic cylinder 65' operated by the control system.

In the next sequential step, step 228 (FIG. 16A), the garment support bar 175 (FIG. 1), if provided, or the garment tumbling device 180 (FIG. 12), if provided, will be raised into an operative position for supporting the garment thereon as the waistband is sewn into the garment. The machine then advances to step 229 (FIG. 16A) and queries whether the machine's waistband expansion assembly is in automated mode, and if not will move through step 230 to step 240. If, however, the waistband expansion assembly is in its automated mode, the program will proceed from step 231 to step 233, in which the auto tension subroutine occurs. Step 233 includes the step of polling receiver 61 of the waistband attachment assembly, which would be accomplished by the subroutine of steps 233–237. As described above, a beam of light is emitted from emitter 60 (FIG. 3) and bounced off of the inside of the garment. Once the light beam is received by receiver 61, the garment is in a properly expanded or tensioned state. If in step 237 (FIG. 16A) the light beam is not received, the program loops back on itself to step 233. If, however, the light beam is received indicating that the garment is in a properly sized and tensioned state, step 238 is executed in which the machine control system then executes step 240, at which point the puller roller assembly 24 (FIG. 3) is activated such that puller roller 25 is moved downwardly into engagement with the compensation roller 29, pinching the garment therebetween for the purpose of moving it along the sewing path.

Based on the size of the garment selected from the list of parameters contained in the control system 190 (FIG. 14), and displayed on data display and entry device 200, the computer 190*a* then calculates the size, i.e. length of the hem, and calculates the number of stitches required to move the garment along the sewing path until such time as the bottom edge guide assembly will be disengaged. Once this calculation is complete, the machine then moves to step 242 (FIG. 16A) and upon engagement of a start switch, initiates a pre-fold operation, also known as a pre-sew or a jog, at which point the top ply of the waistband portion of the garment is folded about the elastic waistband as it is advanced along the sewing path toward the sewing head assembly. During the pre-fold cycle the machine will move to decisional block 244 and query whether the start switch has been triggered, or whether a timed auto operation has been triggered. If not, the machine will loop back to step 242 in step 245. If so, however, the machine will advance at step 246 to step 248 and turn on the blowers 88, 89, 90 (FIG. 6A) of the bottom edge guide assembly, and the blowers 171, 172, 173 (FIG. 11) of the folder assembly. The machine next advances to step 249 (FIG. 16A) and begins to guide the bottom edge guide assembly with bottom edge guide detector. In step 252 the puller roller assembly begins to draw the material along the sewing path, and in step 253 the pre-fold countdown is started within the machine.

Figure 17A:
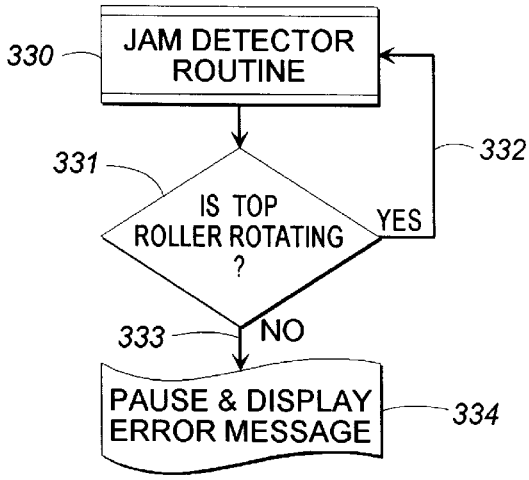
FIG. 17A is a flow chart of ajam detector subroutine used with the machine control routine of FIGS. 16A–16C.

Simultaneous with the operation of the machine in steps 250–253, step 254, a jam detection subroutine occurs, which is illustrated in FIG. 17A. In the jam detection subroutine the control system executes step 331 to determine whether the top roller is rotating. This is accomplished by polling proximity sensor 114 (FIG. 8) to make sure that it is sensing or reading the teeth or timing marks of the timing disc or gear 112 formed as a part of top roller 108. If it is determined that the top roller is rotating in step 332 (FIG. 17A), the program loops back on itself and will continue to do so as the machine operates. If, however, it is detected that the roller is not rotating in step 333, the machine will advance to step 334 and will stop machine operation and display an error message on the data display and entry device.

Figure 17B:
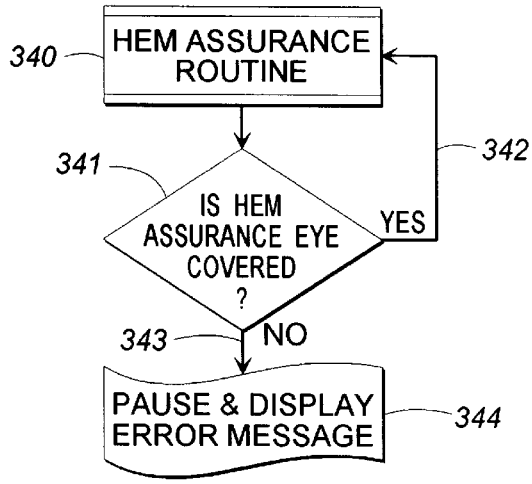
FIG. 17B is a flow chart of a hem assurance subroutine used with the machine control routine of FIGS. 16A–16C.

Referring once again to FIG. 15A, simultaneous with the beginning of the jam detection subroutine of FIG. 16A, the hem assurance subroutine illustrated in FIG. 17B also occurs. The hem assurance subroutine is started at step 340, and then proceeds to the decisional step executed in block 341 in which the hem assurance, sensor 165 (FIG. 11) positioned adjacent trim detector 164 is polled to determine whether it is covered by the garment. If it is covered, as determined in step 342 (FIG. 17B), the program continues to loop back on itself during machine operation. If, however, in step 343 it is determined that the hem assurance eye is not covered, indicating that the unfinished waist edge of the garment is not fully covering the elastic waistband, and is thus not being guided by the trim detection eye toward and into the knife of the sewing head assembly, then the machine stops operation in step 344 and displays an error message on the data display and entry device.

Referring now to FIG. 16B, in step 257 the pre-fold cycle, or pre-sew cycle, continues as initiated by step 242, such that in step 258 the machine queries the side seam 174 (FIG. 10B) detector to see if a side seam in the waistband of the garment has been detected. If not, the machine loops through step 260 to step 257 until such time as a side seam is detected in step 261 by side seam detection switch 174 (FIG. 10B). Once this occurs the machine advances to step 262 (FIG. 16B), and queries the trim detector and quality assurance sensor as to whether a hem has been formed. If not, the machine advances to step 264 and stops operation and displays an error message on the data display and entry device. If the answer is yes in step 265, the machine proceeds to step 266 and commences the sewing operation in step 268 at which point the puller roller assembly will feed the waistband portion of the garment to the sewing head assembly by pulling it along the sewing path in step 269.

In step 270 the bottom edge guide detector (FIG. 7) 98, positioned on arm 97, is moved inwardly and across the sewing path toward the work table, or away from the operator standing at the machine, by position cylinder 93. The bottom edge guide eye will guide the unfolded waist edge of the garment inwardly of the machine such that drive motor 76 (FIG. 6B) is signaled to move drive chain 80 in the direction of the work table such that carriers 81, and guide wheels 82 thereon, pull the unfolded waistband portion of the garment toward the work table, and begin to overfeed it into folder wire assembly 102 (FIG. 2) and folder assembly 148. As the material is first fed into the machine during the pre-fold cycle in steps 242 and 257 (FIG. 16B), the unfinished waist edge of the top ply of the now folded garment is placed in alignment with the trim detector 164 (FIG. 11), such that it is aligned with knife 170. In step 272 (FIG. 16B), performed simultaneously with the performance of step 270 by the machine controller, the trim detector is moved across the sewing path and outwardly or away from the work table and toward the machine operator standing at the machine by position cylinder 166 (FIG. 11). In so doing, the signals emitted by the trim detector to computer 190*a* (FIG. 15) will cause the top edge guide assembly 128 (FIG. 10), as needed, to operate drive motor 138, which will in turn move guide roller 134 on the ply of the folded garment such that guide wheels 136 will draw material about the folded hem of the waistband portion of the garment to take material away from the trim detector and the knife.

Thus, due to the progressive overfeeding of the garment by the bottom edge guide assembly, and the precise control of the unfinished waist edge by the trim detector in conjunction with top edge guide assembly, the unfinished waist edge of the now folded waistband portion of the garment is progressively fed into the knife of the sewing head assembly until a desired amount of fabric is fed into the knife and trimmed. This trim typically will be no more than ⅜ of an inch, and can be varied as desired. As the bottom edge guide assembly progressively overfeeds in step 272 (FIG. 16B), the top edge guide assembly will progressively take away, as needed, to ensure that the unfinished waist edge of the garment is progressively fed into the knife, which, in fashion heretofore unknown in the art prevents the formation of secondary folds in the folded hem/waistband of the garment, and also helps to prevent the formation of tabs at the beginning and end of the hem and makes it possible to place button holes accurately along the hem of the waistband portion of the garment. This process of over-feeding by the bottom guide and pulling back excess material by the top guide continues, creating a tight wrap around the elastic.

Still referring to FIG. 16B, as the unfinished waist edge of the garment is directed progressively into the knife of the sewing head assembly in steps 270 and 272, the computer 190*a* (FIG. 15) is calculating, i.e. it is counting down, the length of garment passed therethrough by counting the revolutions of the sewing head, one revolution equaling one stitch, the number of stitches per inch being known through the mechanical gearing of the sewing head, such that, as shown in steps 274 and 276 (FIG. 16B), once the bottom guide countdown has finished in step 276, the system proceeds in step 278 to step 280, whereupon it disengages, or stops guiding with the bottom edge guide assembly from the bottom edge guide idler roller 84 (FIG. 6A), and simultaneously turns off the bottom edge guide blowers 88 and 89. At the same time, the stacking routine step 282, is engaged to begin the removal and stacking of the garment as discussed below in FIGS. 18A–C.

The computer then polls the hem seam detection switch in step 283 (FIG. 16B), so that in step 284 it is determined whether the hem seam has been detected which would occur when the sewn portion of the hem returns back along the sewing path toward the sewing head such that it deflects the seam detection switch 118 (FIG. 8) for emitting a signal of this fact to the computer. If the seam has not been detected in step 285, the program will loop back on itself until such time as it does detect the seam. This loop continually occurs during machine operation, until such time as the seam has been detected in step 286 or until a cycle time out timer has elapsed, whereupon the folder tongue 158 (FIG. 11) is then retracted from fixed hem folding guide 169 in step 288 (FIG. 16B). Also, simultaneous with the detection of the hem seam of the now sewn portion of the hem, an oversew counter is started, i.e. stitches are counted which will equate to the known length traveled from the seam detection switch to the needles of the sewing head, in step 289. In step 290, therefore, the condensed stitch, or oversew operation is started such that in step 292 it is determined whether the oversew countdown is finished. If not, the program loops back on itself in step 293 until such time as the oversew countdown is finished in step 294. Once the oversew countdown is finished, the top edge guide assembly is disengaged from the fabric ply of the hemmed and sewn garment in step 296, and in step 297 the puller roller of the puller roller assembly is signaled and is moved upwardly and away from engagement with compensation roller 29 such that the garment is no longer drawn along the sewing path.

Referring now to FIG. 16C, in step 298 the condensed stitch countdown is started as shown in steps 300–303. In step 301 the machine has counted the number of stitches sewn in the garment based upon a predetermined number, or time period, input into the machine to determine whether the condensed stitch count has been completed. If not, the machine loops back on itself in step 302 until such time as the condensed stitch count is met in step 303. Once this has occurred, the puller roller is signaled in step 305 to be lowered back into engagement with the compensation roller and starts to draw the now finished garment back along the sewing path while a predetermined number of stitches are counted off in step 306.

In step 308 the finished stitch count subroutine is started, such that in step 309 the machine is polled as to whether the calculated number of stitches in the stitch countdown is completed. If not the machine loops back on itself in step 310 until such time as it is detected, whereupon in step 312 the machine advances to step 313 at which time an undertrim operation is performed to cut the thread chain formed by steps 305–312. Thereafter, the puller roller is lifted from engagement with the compensation roller once again instep 314, and a now completed garment may be removed from the machine in step 316. In step 317 all machine components are reset back to their default state for the next cycle, i.e. the sewing of an elastic waistband into the next successive garment, whereupon step 318, also step 212, is executed by the control system.

Figure 18A:
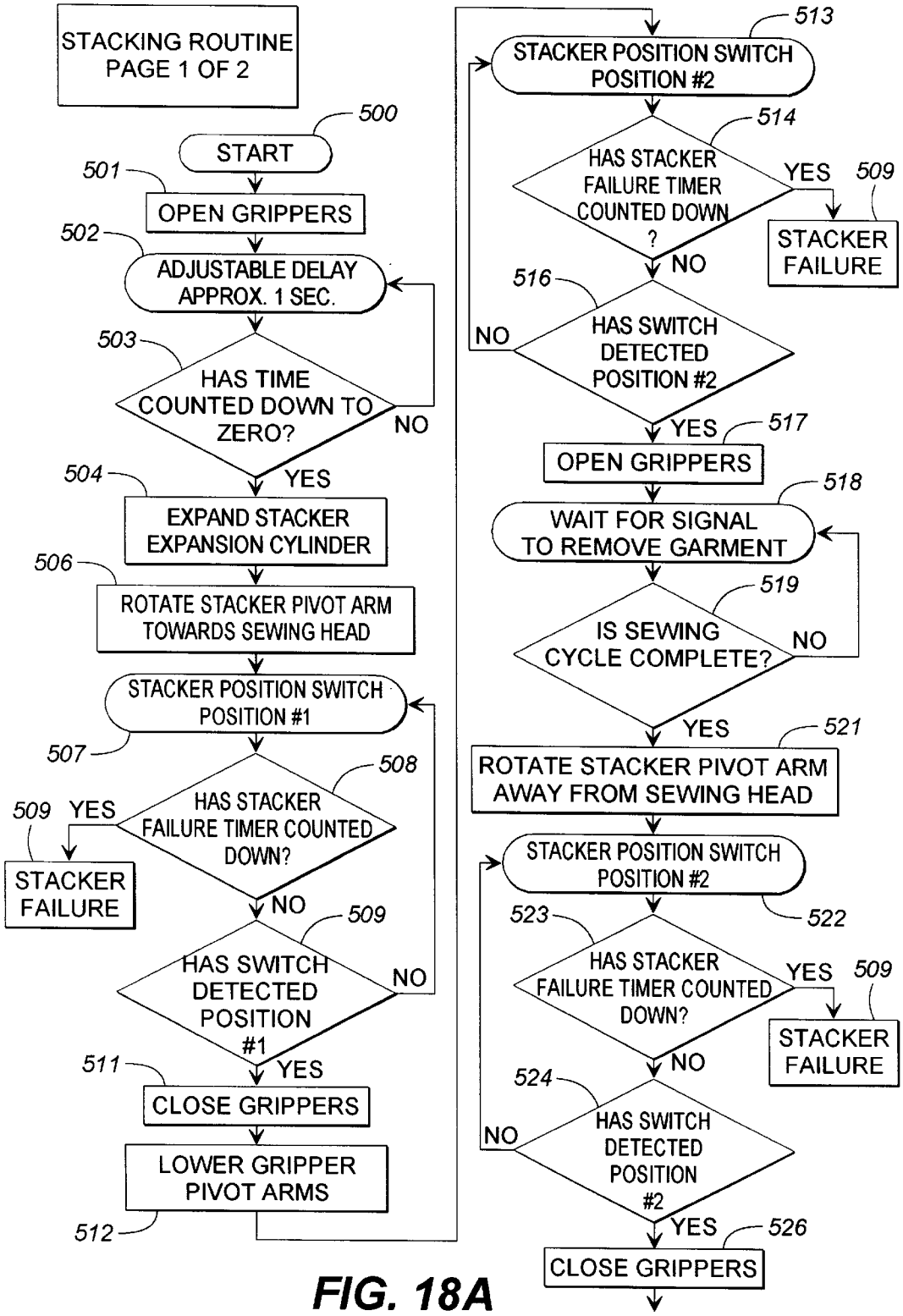
FIGS. 18A–C are flow charts illustrating the stacking subroutine used with the machine control routine of FIGS. 16A–16C.

In addition, as the sewing nears its completion, when the control system signals the bottom edge guide to retract away from engagement with the garment, a corresponding signal is sent to the stacking assembly 400 (FIG. 1) to start the stacking routine 282 (FIG. 16B) as indicated in step 500 in FIG. 18A. As an initial step 501 the grippers of the stacking assembly are opened and the system waits for an adjustable delay in step 502, which typically is approximately one second but can be varied as required. Once the system has counted to zero as indicated in step 503, the system sends a flow of air through one of the air fittings 459 or 461 (FIG. 13) in step 504 (FIG. 13) to cause the rotary actuator 455 to rotate the main pivot arm toward the sewing head of the waistband attachment system as indicated in step 506 (FIG. 18A). In the next step 507, the position sensor 467 (FIG. 13) is checked to see if the main pivot arm has reached a first position as it is being pivoted about its arcuate motion toward the sewing head. In step 508 it is determined whether the failure timer for the stacking assembly has been counted down, and if so, the control system initiates a stacker failure routine 509, illustrated in FIG. 18C. If it is determined in step 508 that the stacker failure timer has not counted down to zero, the system next in step 509, determines whether the position sensor has detected the first position for the main pivot arm. If not, the system is returned to step 507.

If the position sensor has detected that the main pivot arm has moved to its first position, the grippers are moved to their closed position in step 511 and the gripper arms are pivoted to their lowered, horizontally extending position in step 512. In step 513, the position sensor is checked to see if the main pivot arm has reached its position number 2 with the grippers being positioned at the upstream and downstream ends of the sewing path, straddling the garment and extending slightly inwardly from the waistband edge of the garment. The system again checks in step 514 to see if the stacker failure timer has counted down to zero and if so it proceeds to the stacker failure routine 509 illustrated in FIG. 18C. If the stacker failure timer has not been counted down, the system checks to see if the position sensor has detected the main pivot arm moving to its position number 2 in step 516. If not, the control system goes back to step 513 and again samples the proximity sensor to determine if the main pivot arm has reached its position number 2. Once the main pivot arm has reached its position number 2, the system proceeds to step 517 wherein the grippers are moved to their open position. Thereafter, in step 518, the stacking assembly waits for a signal from the control system before proceeding with the removal of the garment from the sewing area. In step 519, the system checks to see if the sewing cycle has been completed as indicated by the actuations of the trim cycle 313 (FIG. 16C) and if not, it continues to wait for a signal to remove the garment.

Once the sewing cycle has been completed, the system proceeds to step 521 (FIG. 18A) in which the main pivot arm begins to be rotated away from the sewing head of the waistband attachment system as the grippers engage the waistband of the garment between their bills and slips and begin to pull the garment away from the sewing head.

Figures 18B, 18C:
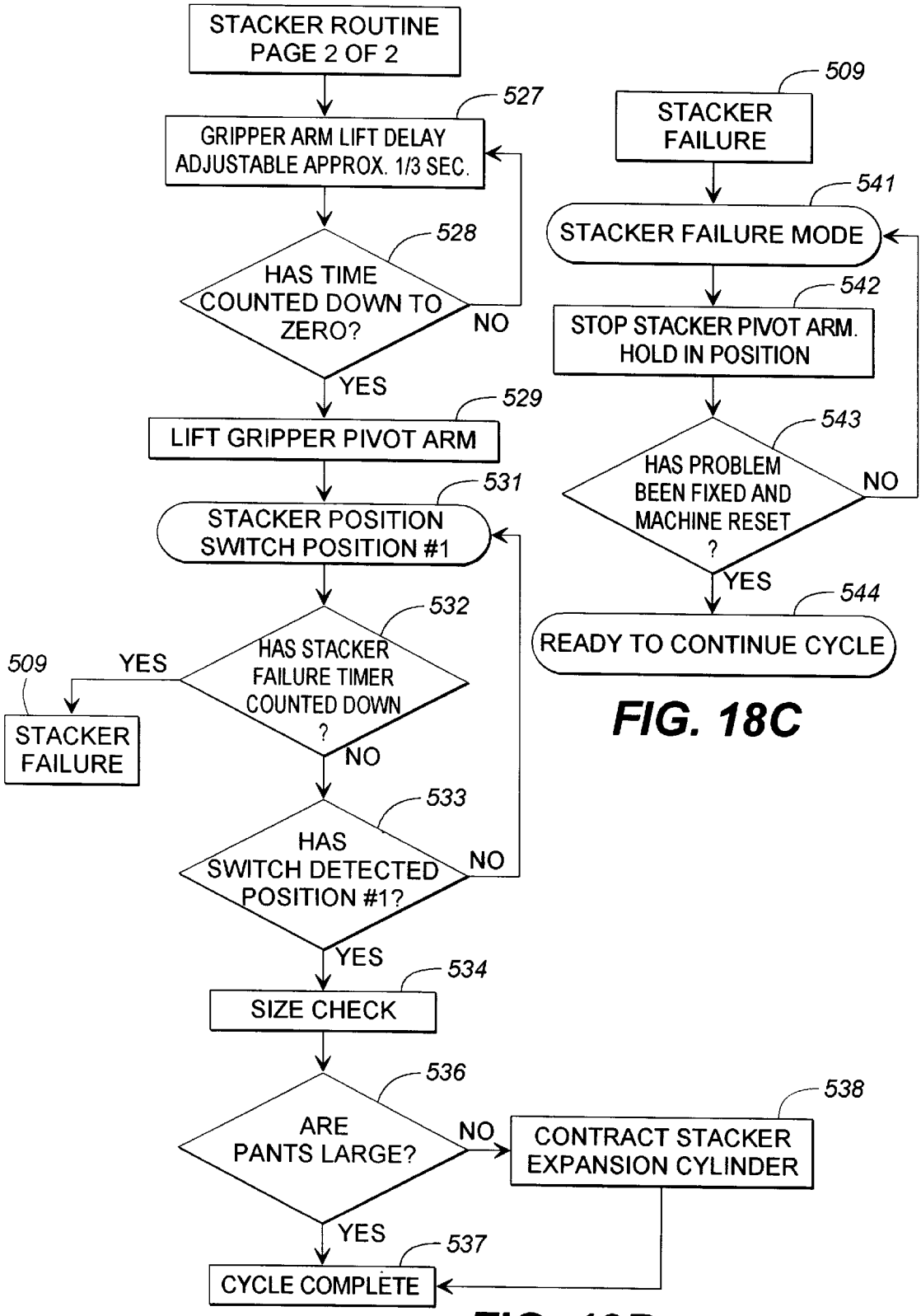

As the main pivot arm is moved away from the sewing head, the proximity sensor is again checked in step 522 to see if the main pivot arm has been moved back into its position number 2. In step 523 the system checks to see if the stacker failure timer has counted down and if so proceeds to the stacker failure routine 509 (FIG. 18C). If the stacker failure timer has not counted down, the system proceeds to step 524 (FIG. 18A) to determine if the proximity sensor has detected the movement of the main pivot arm into its position number 2. If not, the system is returned to step 522 and again looks for the main pivot arm being moved to position number 2. If position number 2 of the main pivot arm has been detected, the system proceeds to step 526 in which the grippers are moved to their closed position to pinch the edge of the garment and expand the waist portion of the garment as the garment is being pulled off of the top roller 108 (FIG. 1) and the compensation roller 29 and away from the sewing head. In step 527 (FIG. 18B), the system waits for a programmed delay of approximately ⅓ of a second, which time is adjustable as desired, before beginning to pivot the gripper arms of the gripper assembly from their lowered, horizontally extending position into a raised, substantially vertically extending position. The system checks in step 528 to see if the delay has been exceeded and if not, continues to wait for the delay as indicated in step 527. Once the time delay has passed, the gripper arms are pivoted or lifted to their raised, vertically extending position in step 529.

In step 531, the computer control for the waistband attachment system samples the position sensor to determine if the rotating main pivot arm has reached its position number 1. In step 532, the system checks to see if the stacker failure timer has counted down, and if so, proceeds to the stacker failure routine 509 illustrated in FIG. 18C. If the stacker failure timer has not counted down to zero, the system checks, in step 533 (FIG. 18B), to see if the position sensor has detected the main pivot arm moving into its position number 1. If not, the system is reset back to step 531. If the main pivot arm has been detected to be at its position number 1, the system performs a size check in step 534. If the pants are determined to be of a large size, as indicated in step 536, the stacking cycle is completed as indicated in step 537. If the pants are determined to be of a smaller size or sizes, the system proceeds through an additional step 538 in which the travel cylinder 441 (FIG. 13) for gripper arm 413 is supplied with a flow of air so as to cause it to retract its cylinder rod 443. As the cylinder rod 443 is retracted, slide block 436 and thus gripper arm 413 is moved laterally in the direction of arrow 414 to reduce the tension in the waistband of the garment. This allows the front portion of the garment to partially sag so that the rear seam and oversew area of the garment are exposed for easy visual inspection by the operator. By positioning the rear seam end oversew area of the garment in such a way as to enable easy visual inspection by the operator, the operator can quickly determine if there is a tab or additional loose threads that need to be trimmed from the garment prior to the garment being stacked or if a more serious defect or fault condition exists such as the lines of stitching at the oversew area being misaligned. Thus, the operator can quickly spot potential problems and defects and can correct such defects either by trimming such a tab or excess thread or by making adjustments to the waistband attachment system or other sewing station with which the stacker is used.

At the completion of the cycle, the grippers hold the garment in their raised position with the rear seam and oversew area of the garment facing the operator to enable, the operator visually inspects the garment. In this position, the body of the garment typically is draped over the stacker bar 477 (FIG. 13) on top of a previously stacked garment. Once the operator has made her inspection and has loaded additional garment pieces on the sewing station and has actuated the start switch for the attachment system, the grippers then release the garment and allow the waistband portion of the garment to drop over the stacker bar to complete the stacking of the garments. This operation is continued automatically as garments are sewn by the attachment system to form bundles or loads of garments that will be transported to later processing stations for further sewing and processing.

The stacker failure operation is illustrated in FIG. 18C. If a stacker failure is detected such as at step 509, the system is placed into the stacker failure mode in step 541 and opens a supply of air on both sides of the vanes of the rotary actuator so as to equalize the air pressure on both sides of the vane of the rotary actuator to stop any further movement of the main pivot arm and hold the main pivot arm in its idle position as indicated in step 542. In step 543, the system checks to see if the problem has been fixed and the machine reset. If not, the system returns to step 541 and continues to monitor the machine to see if the error or fault condition is fixed. Once the fault condition has been fixed, the system returns to continued operation in step 544 to finish the stacking cycle.

Figure 19A:
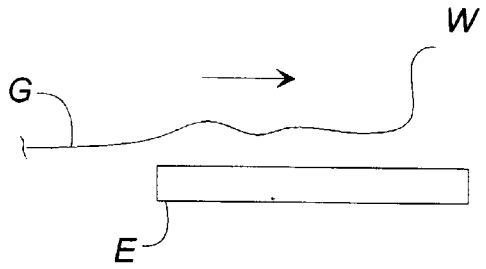
FIGS. 19A–19D are sequential schematic illustrations showing the folding of a top ply of a garment about an elastic waistband and into an overlying relationship with a bottom ply of the garment, and the alignment of an unfinished waist edge of the top ply of a garment with the knife of the sewing head assembly of the waistband attachment system of the invention.
Figure 19B:
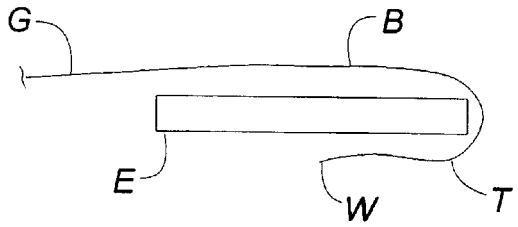

The sewing of the waistband into the garment is schematically illustrated in FIGS. 19A–D. In FIG. 19A, the unfinished waist edge W of the unfolded garment G is being guided laterally across the sewing path by the bottom edge guide assembly, as described in greater detail above, for being folded about the elastic waistband E. As the garment is being advanced along the sewing path in the pre-fold or pre-sew operation described above, the unfinished waist edge of the garment is folded about the elastic waistband E by the folder wire assembly, such that a top ply "T" and a bottom ply "B" of the garment are formed, as shown schematically in FIG. 19B.

Figure 19C:
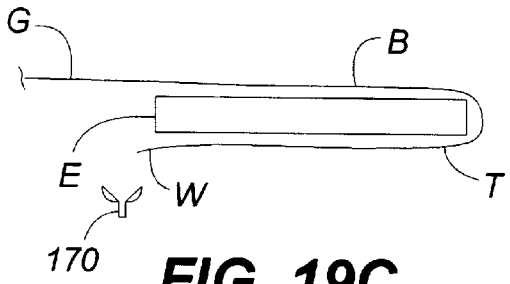

Once the pre-sew operation has been completed, the unfinished waist edge W of the garment is progressively guided into the knife of the sewing head assembly, as shown schematically in FIG. 19C. This, described in greater detail above, is accomplished by the inward movement of the bottom edge guide detector, and the outward movement of the trim detector, such that the unfinished waist edge is progressively guided into the knife. This is also assisted by blowers 171, 1772, 173 (FIG. 11) which are serving to remove curl from the garment, and will also help to blow the unfinished waist edge of the garment into the knife as the garment progresses along the sewing path.

Figure 19D:
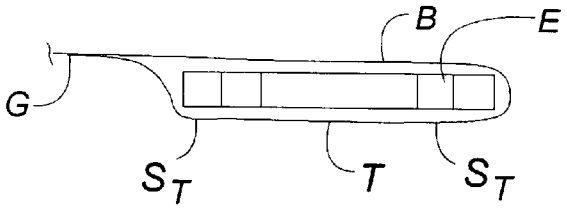

Lastly, as shown in FIG. 19D, the garment has now been hemmed such that four parallel lines of stitching, denoted by the reference character "$S_t$" have been sewn into the waistband, and the unfinished waist edge of the garment has been trimmed to a desired finish length.

The present invention provides, therefore, for higher production rates using relatively unskilled system operators than are attainable using the known machines and methods of the art, and which due to its novel construction and method of use, greatly minimizes the likelihood of pleat formation, as well as tab and curl formation during, and at the end, respectively, of the waistband attachment process. Thus, the present invention substantially reduces the likelihood of defects being sewn into the finished garment. Moreover, the relative simplicity and ease of use of this waistband attachment system, in comparison with known waistband attachment systems and methods, and its high degree and ease of adjustability allows for a higher degree of flexibility in that this construction is readily adapted for sewing waistbands in a wide range of garment types, and sizes, to include variations in the sizes of the elastic waistbands so sewn, to yield consistently finished high quality garments.

It will also be understood by those skilled in the art that while the present invention has been disclosed with use for forming tubular garments having an elastic waistband sewn about the waist portion thereof, the present invention also can be used for sewing various other types of tubular workpieces including bags, pillowcases, or other garments such as T-shirts without requiring an elastic waistband be sewn therein. It is also possible to sew pants or other garments or work pieces having a draw string or a rope enclosed within a folded and sewn hem in place of an elastic band if necessary and/or desired. Thus, the present invention is not limited to garments having elastic waistbands, but can be used for sewing a variety of other garments or work pieces so as to enable the user of the present invention to change the types of garments sewn on a frequent basis, such as, for example, sewing a pair of elastic waistbanded sweat pants one day and changing to bottom hemming T-shirts all the next, on the same system without requiring separate machines for each different sewing operation.

It further will be understood that the stacking assembly disclosed herein is not limited for use solely with a waistband attachment system, but rather can be utilized for stacking a variety of different types or styles of garments formed on a variety of different sewing stations or automated sewing equipment. Thus, the stacking assembly will be recognized as having additional applications and is not limited solely to the waistband attachment system disclosed above.

While preferred embodiments of the invention have been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims are intended to include any structure, material, or acts for performing the functions in combination with other claimed elements, as specifically claimed.

We claim:

1. A stacking assembly for automatically removing and stacking tubular garments from a sewing station, comprising:

a pivot arm movable between a disengaging position displaced from the sewing station and an engaging position at the sewing station;

means for moving said pivot arm between its disengaging and engaging positions, mounted to said pivot arm in a driving relationship;

a gripper assembly mounted on and carried with said pivot arm; and said gripper assembly including gripper arms each having a gripper mounted thereto, said gripper arms pivotable between a raised holding position and a lowered position for engaging the garments;

whereby as said pivot arm is moved to its engaging position, said gripper arms are moved to their lowered position for engaging the garments and as said pivot arm is moved to its disengaging position, said gripper arms are moved to their raised position to remove and transport the garments from the sewing station to a stacking position.

2. The stacking assembly of claim 1 and further including a stacker bar positioned adjacent said disengaging position of said pivot arm for receiving garments for stacking thereon.

3. The stacking assembly of claim 1 and wherein said gripper assembly further includes a cylinder for moving at least one of said gripper arms laterally with respect to the other of said gripper arms.

4. The stacking assembly of claim 1 and wherein said means for moving said pivot arm comprises a rotary actuator having a drive shaft connected to said pivot arm.

5. The stacking assembly of claim 1 and wherein said grippers each comprise a hook portion pivotably attached to a gripper arm and movable between open end closed positions, a clip mounted to said gripper arm and extending adjacent said hook portion for engaging and holding the garments when said hook portion is in its closed position.

6. The stacking assembly of claim 4 and further including a timing vane mounted to a lower end of said drive shaft of said rotary actuator and a sensor positioned adjacent said timing vane for detecting a position of said pivot arm.

7. A method of manufacturing garments, comprising the steps of:

moving garment pieces along a sewing path through a sewing station;

sewing the garment pieces to form a finished garment;

as the garment pieces are sewn, moving a pivot arm and grippers of a stacking assembly into an engaging position adjacent the garment pieces;

after the sewing of the garment pieces is completed, engaging the finished garments with the grippers, and, with the garments held therein, thereafter moving the garments away from the sewing station toward a disengaging position; and releasing the garment pieces and stacking the garments in bundles.

8. The method of claim 7 and further including the step of holding the garments with the grippers in a raised position to enable visual inspection of the garments by an operator.

9. The method of claim 7 and further including the steps of opening the grippers as the pivot arm is moved toward its engaging position, closing the grippers about a portion of the garments to engage and grip the garments, moving the pivot arm toward its disengaging position displaced from the sewing station, and thereafter moving the grippers to an open position for release of the garments at a stacking station.

10. A method of manufacturing garments, comprising the steps of:

moving garment pieces along a sewing path through a sewing station;

sewing the garment pieces to form a finished garment;

as the sewing of the garment pieces are sewn, moving a pivot arm and grippers of a stacking assembly into an engaging position adjacent the garment pieces;

detecting the size of the garments and moving at least one of the grippers with respect to the other to adjust the position of the grippers according to the size of the garments;

after the sewing of the garment pieces is completed, engaging the finished garments with the grippers, and, with the garments held therein, moving the pivot arm and grippers away from the sewing station toward a disengaging position; and releasing the garment pieces and stacking the garments in bundles.

11. A waistband attachment system for attaching a continuous elastic waistband to a waist portion of a garment as the waistband and the garment are moved along a sewing path extending through a sewing head assembly, said attachment system comprising:

a puller roller for pulling the elastic waistband and the waistband portion of the garment along the sewing path and through the sewing head assembly;

a waistband expansion assembly constructed and arranged to expand the elastic waistband to a predetermined size; and a bottom edge guide assembly for guiding the waistband portion of the garment along the sewing path, said bottom guide assembly being constructed and arranged to selectively guide the waist edge of the gannent into engagement with a knife of the sewing head assembly as the garment advances along the sewing path;

said bottom edge guide assembly including a series of carriers mounted on a drive chain and movable in a direction perpendicular to the sewing path as the garment advances along the sewing path for engaging and moving the garment across the sewing path, each of said carriers being independently movable in the direction of the sewing path to enable a seam of the garment to pass thereunder while others of said carriers are maintained in engagement with the garment.

12. The waistband attachment system of claim 11, wherein said bottom edge guide assembly includes a plurality of air jets constructed and arranged to direct a pressurized air flow across the waistband portion of the garment for removing curls therefrom.

13. The waistband attachment system of claim 11, wherein said carriers of said bottom edge guide assembly are yieldably biased into engagement with an opposed bottom edge guide idler roller, said carriers being constructed and arranged to be moved out of engagement with said idler roller in response to the passage of the garment therebetween.

14. The waistband attachment system of claim 11, wherein said bottom edge guide assembly comprises:

a drive motor;

a drive sprocket rotated by said drive motor, and a spaced driven sprocket for driving said drive chain;

a plurality of rotatable guide wheels affixed to each of said carriers;

means for yieldably biasing each of said carriers in the direction of the sewing path; and a bottom edge guide idler roller positioned downstream from said housing and extending across the sewing path, wherein said respective guide wheels of said carriers selectively engage said idler roller for engaging the garment therebetween to move the garment across the sewing path.

* * * * *